US007461722B2

(12) United States Patent
Kyotani

(10) Patent No.: US 7,461,722 B2
(45) Date of Patent: Dec. 9, 2008

(54) ELEVATING TRANSPORT APPARATUS

(75) Inventor: Hisashi Kyotani, Shiga (JP)

(73) Assignee: Daifuku Co., Ltd., Osaka (JP)

( * ) Notice: Subject to any disclaimer, the term of this patent is extended or adjusted under 35 U.S.C. 154(b) by 363 days.

(21) Appl. No.: 11/146,247

(22) Filed: Jun. 6, 2005

(65) Prior Publication Data

US 2006/0175141 A1 Aug. 10, 2006

(30) Foreign Application Priority Data

Jul. 7, 2004 (JP) ..... 2004-199951

(51) Int. Cl.
*B66B 9/02* (2006.01)
*B66F 7/06* (2006.01)

(52) U.S. Cl. ..... 187/269; 187/211

(58) Field of Classification Search ..... 187/211, 187/269; 254/91

See application file for complete search history.

(56) References Cited

U.S. PATENT DOCUMENTS 2,471,901 A * 5/1949 Ross ..... 254/9 C
4,780,044 A * 10/1988 Elskamp ..... 414/557
4,886,145 A * 12/1989 Iwahashi ..... 254/89 R
5,100,282 A * 3/1992 Maier et al. ..... 414/545
5,209,628 A * 5/1993 Hassell ..... 414/462
5,979,606 A * 11/1999 Wheeler ..... 187/269
2002/0060137 A1* 5/2002 Byeong-Ho ..... 198/750.1

FOREIGN PATENT DOCUMENTS

JP 5-162985 6/1993

* cited by examiner

*Primary Examiner*—Peter M Cuomo
*Assistant Examiner*—Eric Pico
(74) *Attorney, Agent, or Firm*—Fildes & Outland, P.C.

(57) ABSTRACT

An elevating transport apparatus for elevating and transporting a body to be transported, with an elevating section connecting a transport path and a transport path positioned at different heights. A first support shaft in the horizontal direction and a second support shaft are disposed parallel to each other on a stand. The second support shaft can be freely moved to approach or separate from the first support shaft, with guide apparatuses. A crank arm is supported by the second support shaft, and a distal end portion of a swing arm supported by the first support shaft is linked via a linking shaft to an intermediate position of the crank arm. A transport body support apparatus is provided via a free end support shaft on the free end section of the crank arm and can hold the body via a transport machine. Further, an arm drive apparatus is provided to cause the crank arm to rotate around the second support shaft, and a posture adjustment apparatus is provided to rotate the transport body support apparatus around the free end support shaft and maintain the horizontal posture thereof.

5 Claims, 21 Drawing Sheets

ELEVATING TRANSPORT APPARATUS

BACKGROUND OF THE INVENTION

1. Field of the Invention

The present invention relates to an elevating transport apparatus for elevating and transferring a body to be transported, directly or via a transport machine between two transport lines positioned at different heights or between a transport line and a processing and working section positioned at different heights.

2. Description of the Related Art

An apparatus disclosed in Japanese Examined Patent Application No. 5-162985 is an example of the conventional apparatus for connecting two transport lines positioned at different heights and elevating and transporting therebetween a body to be transported.

In this elevating transport apparatus, a plurality of support columns are provided vertically between a base plate and an upper frame, and a carriage that can be elevated between the support columns and a counterweight that can be elevated between the support columns are connected with a chain. A drive apparatus is installed for driving the chain and elevating the carriage. The carriage is provided with rails that can be connected to an upper transport guide rail and a lower transport guide rail.

With the above-described conventional configuration, usually joint-free, integral support columns are used with consideration for smooth elevation, efforts required for level alignment during installation, and maintenance. However, the following problem rises when the elevating stroke is large: the support columns have a large length and are difficult or expensive to transport on a truck from the support column manufacturing plant to the installation site.

Accordingly, it is an object of the present invention to provide an elevating transport apparatus that can ensure a sufficient elevating stroke, without using long support columns.

SUMMARY OF THE INVENTION

The first aspect the invention provides an elevating transport apparatus for the installation on an elevating section connecting two transport paths positioned at different heights or a transport path and a processing and working position positioned at different heights and use for elevating and transporting a body to be transported, directly or via a transport machine. This apparatus comprises a first support shaft in the horizontal direction, a second support shaft disposed parallel to the first support shaft, guide means that causes at least one of the first support shaft and the second support shaft to freely move so as to approach or separate from the other, a crank arm supported by the second support shaft, a swing arm supported by the first support shaft and having a distal end portion linked via a linking shaft to an intermediate position of the crank arm, transport body support means that is rotatably supported via a free end support shaft on the free end section of the crank arm and can hold the body to be transported, directly or via a transport machine, an arm drive apparatus causing the crank arm to rotate around the second support shaft, and a posture adjustment apparatus that can rotate the transport body support apparatus around the free end support shaft and maintain the horizontal posture thereof.

According to the first aspect of the invention, rotating the crank arm in the up-down direction about the second support shaft makes it possible to set an elevating stroke of the transport body support means at a large level, at maximum to an almost two-fold length of the crank arm, which determines the scale of the elevating transport apparatus. Therefore, the crank arm, which is the member determining the scale of the elevating transport apparatus, can be made sufficiently shorter than the elevating stroke, the parts can be easily handled, truck transportation from the manufacturing plant to the installation site (plant) can be easily conducted, and the transportation cost can be greatly reduced.

DESCRIPTION OF THE PREFERRED EMBODIMENTS

Embodiments of an elevating transport apparatus for elevating and transferring a body M to be transported, between transport paths with different heights in accordance with the present invention will be described below with reference to the appended drawings.

Embodiment 1

Embodiment 1 of the elevating transport apparatus will be described below with reference to FIGS. 1 to 7.

Figure 1:
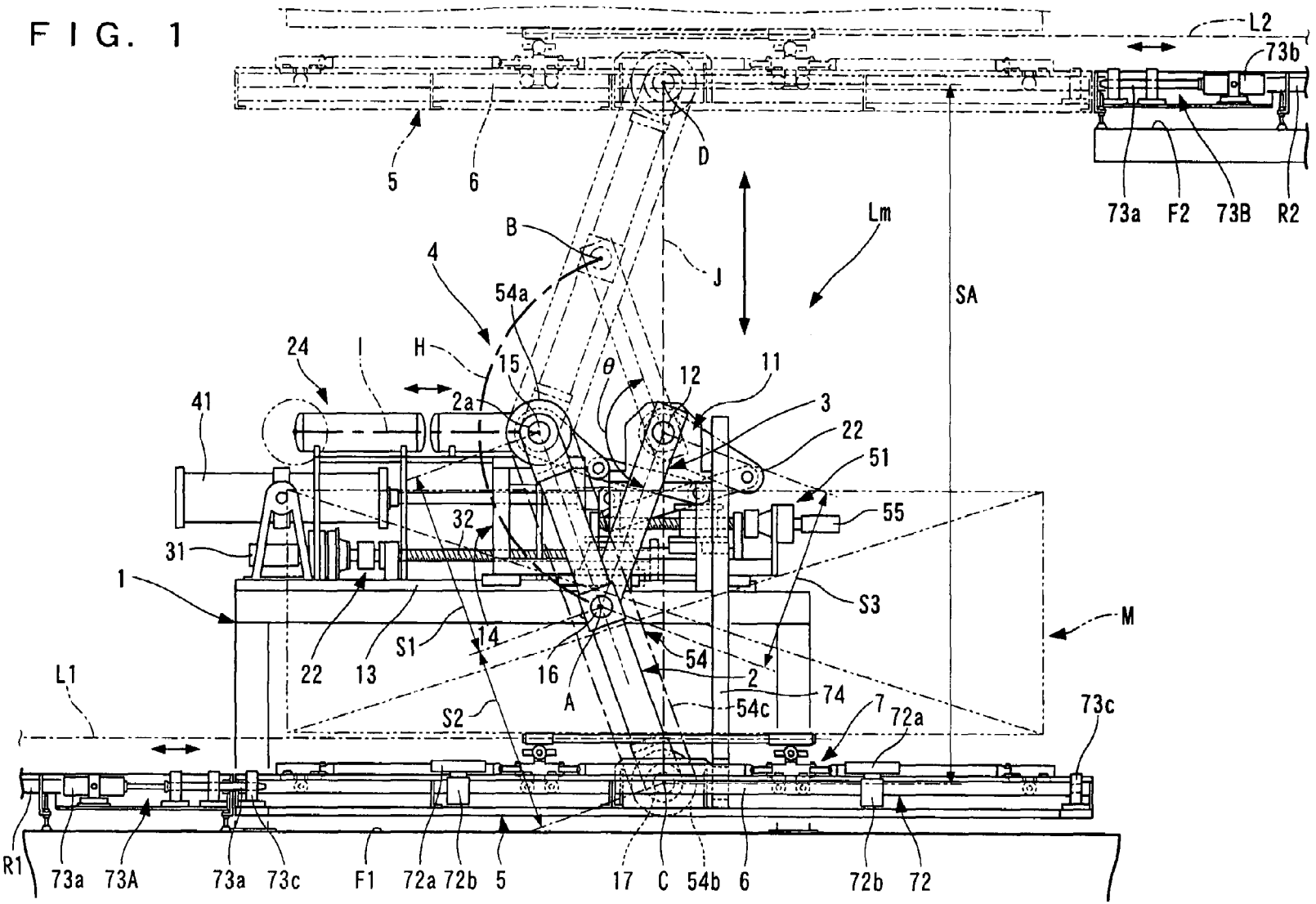
FIG. 1 is a general front view illustrating Embodiment 1 of an elevating transport apparatus in accordance with the present invention.
Figure 2:
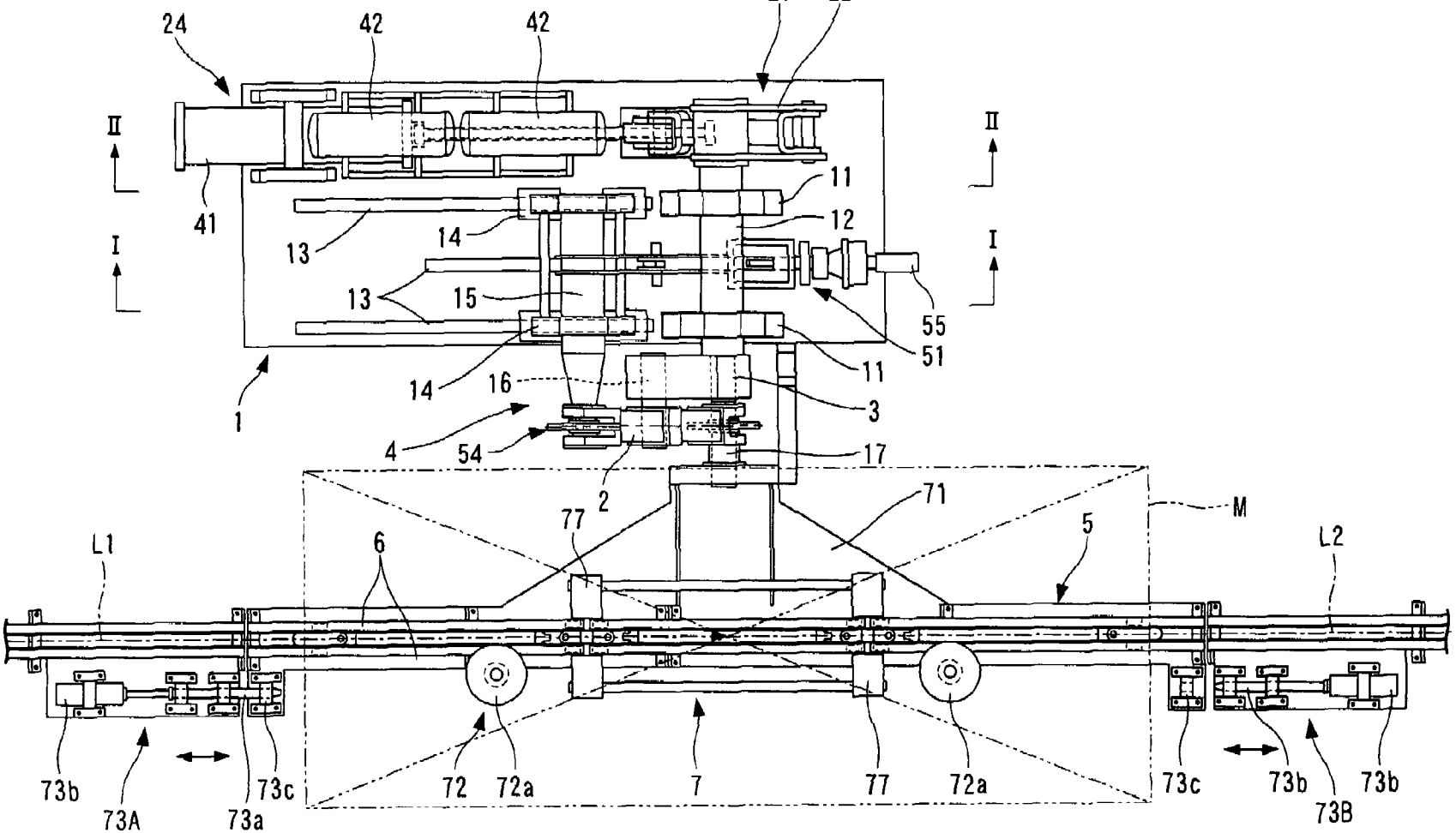
FIG. 2 is a general plan view of the elevating transport apparatus.

As shown in FIG. 1 and FIG. 2, for example, a lower transport rail R1 is installed along a lower transport line (transport path) L1 on the lower surface F1 of the first floor. Further, an upper transport rail R2 is installed along an upper transport line (transport path) L2 of the upper surface such as the ceiling section or the second and third floors F2. As for an elevating transport apparatus 4, the lower transport rail R1 of the lower transport line (transport path) L1 and the upper transport rail R2 of the upper transport line L2 are connected to each other and the elevating transport apparatus 4 is disposed in the space of the elevating section Lm thereof.

The crank-type elevating transport apparatus 4 is disposed on a stand 1 disposed on the lower floor surface F1. This elevating transport apparatus 4 is equipped with a crank arm 2 and a swing arm 3. A movable transport rail apparatus (transport body support means) 5 that has an elevating rail 6 that can be connected to the lower transport rail R1 and upper transport rail R2 is supported on the free end portion of the crank arm 2. With this elevating transport apparatus 4, the body M to be transported and is held on a transport cart (transport machine) 7, is lifted or lowered and transported via the movable transport rail apparatus 5, and the transport cart 7 is free to move on the lower transport rail R1 and upper transport rail R2 and on the elevating rail 6.

In the elevating transport apparatus 4, a pair of left and right fixed bearing members 11 are provided on one end side of the transport lines L1, L2 above the stand 1, and a first support shaft 12 extending in the horizontal direction perpendicular to the direction of the transport lines L1, L2 is rotatably supported by the fixed bearing member 11. At the other end sides of the transport lines L1, L2 above the stand 1, a plurality of guide rails (guide means) 13 are installed parallel to the transport lines L1, L2 and a movable bearing member (guide means) 14 is disposed so that it is guided by the guide rails 13 via respective thrust bearings. A second support shaft 15 that is parallel to the first support 12 shaft and positioned in the same horizontal plane is supported by the movable bearing member 14. The fixed end portion of the swing arm 3 is attached to the front end side (transport rail R1, R2 side) of the first support shaft 12. Further, the fixed end portion of the crank arm 2 is rotatably supported via a bearing 2*a* on the front end side of the second support shaft 15. A free end portion of the swing arm 3 is rotatably connected to the intermediate portion of the crank arm 2 via a connection shaft 16. Further, the movable transport rail apparatus 5 is supported, so that the posture thereof can be adjusted, via a free end support shaft 17 on the free end portion of the crank arm 2.

Here, preferably, the optimum setting is S1:S2:S3=1:1:1, where S1 is the length of the crank arm 2 from the second support shaft 15 to the connection shaft 16, S2 is the length of the crank arm 2 from the connection shaft 16 to the free end support shaft 17, and S3 is the length of the swing arm 3 from the first support shaft 12 to the connection shaft 16. This is because if the swing arm 3 rotates within a range with a maximum angle θ° (in the figure, for example, 160°) and the connection shaft 16 moves within a range A ⇔B on the first circular arc trajectory H, as shown in FIG. 1, then the second support shaft 15 moves reciprocally via the movable bearing member 14 on the linear trajectory I and, at the same time, the crank arm 2 rotates between C and D and the free end support shaft 17 moves linearly in the vertical direction within a range C ⇔D of the elevating and transport line J.

Further, even with S1:S2:S3≈1:1:1, an almost vertical trajectory can be formed and no problem rises within a tolerance range with a small displacement in the horizontal direction.

Any of the below-described drive apparatuses can be used as an arm drive apparatus for driving the crank-type elevating transport apparatus 4.

(1) A rotary drive apparatus for rotating the first support shaft 12.

(2) A rotary drive apparatus for rotating the second support shaft 15.

(3) A linear movement apparatus that causes at least one member of the fixed bearing member 11 and movable bearing member 14 to move along the transport line direction so as to approach the other member, thereby decreasing or increasing the distance between the first support shaft 12 and second support shaft 15, that is, (3a) a linear movement apparatus that causes the fixed bearing member 11 to move along the transport line direction so as to approach the movable bearing member 14, thereby decreasing or increasing the distance between the first support shaft 12 and second support shaft 15, (3b) a linear movement apparatus that causes the movable bearing member 14 to move along the transport line direction so as to approach the fixed bearing member 11, thereby decreasing or increasing the distance between the first support shaft 12 and second support shaft 15, (3c) a linear movement apparatus that causes the fixed bearing member 11 and movable bearing member 14 to move along the transport line direction so as to approach each other, thereby decreasing or increasing the distance between the first support shaft 12 and second support shaft 15. Here, apparatus (1) is employed as the arm drive apparatus 21.

Figure 3:
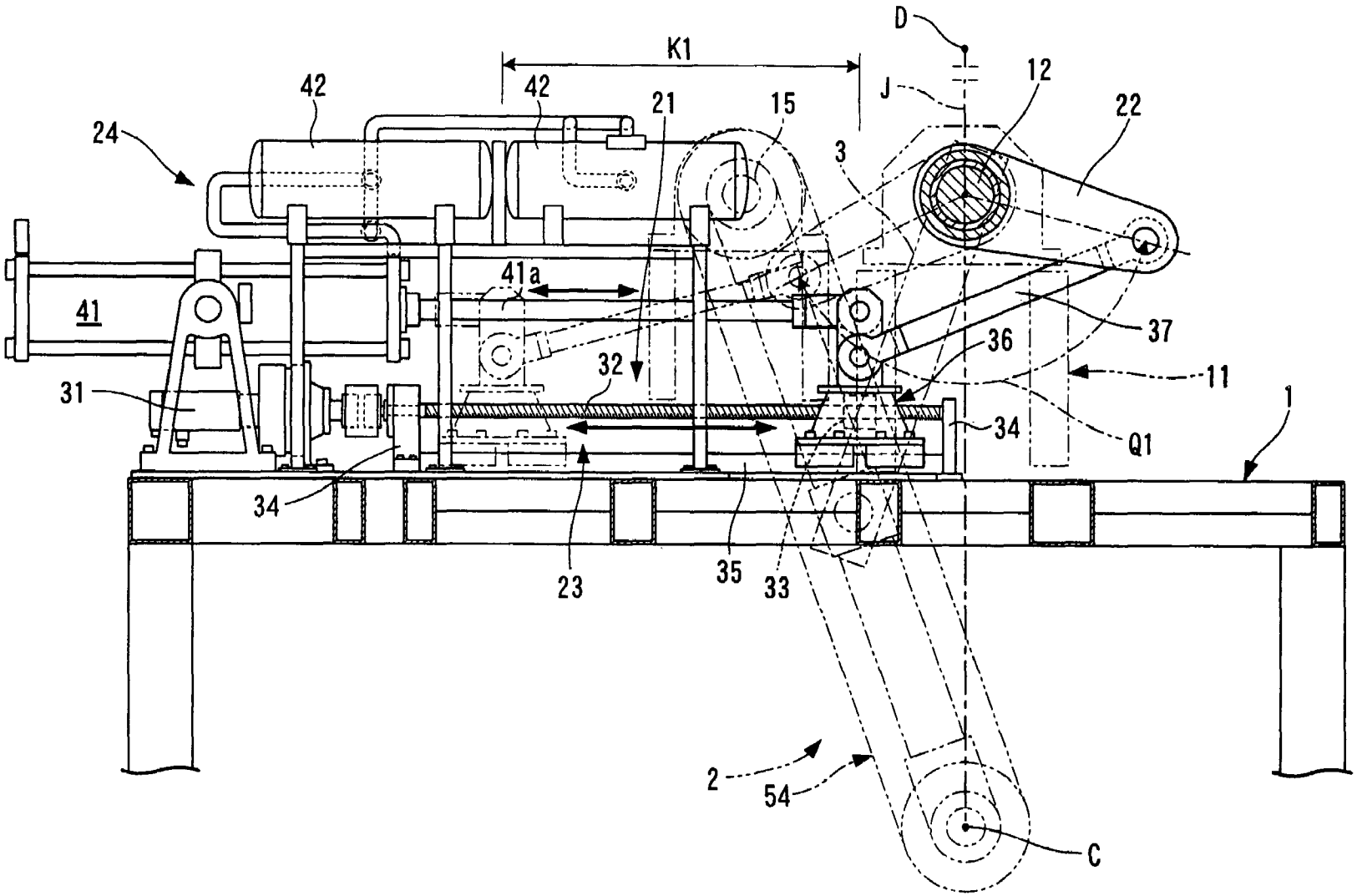
FIG. 3 is a cross-sectional view along II-II in FIG. 2.
Figure 4:
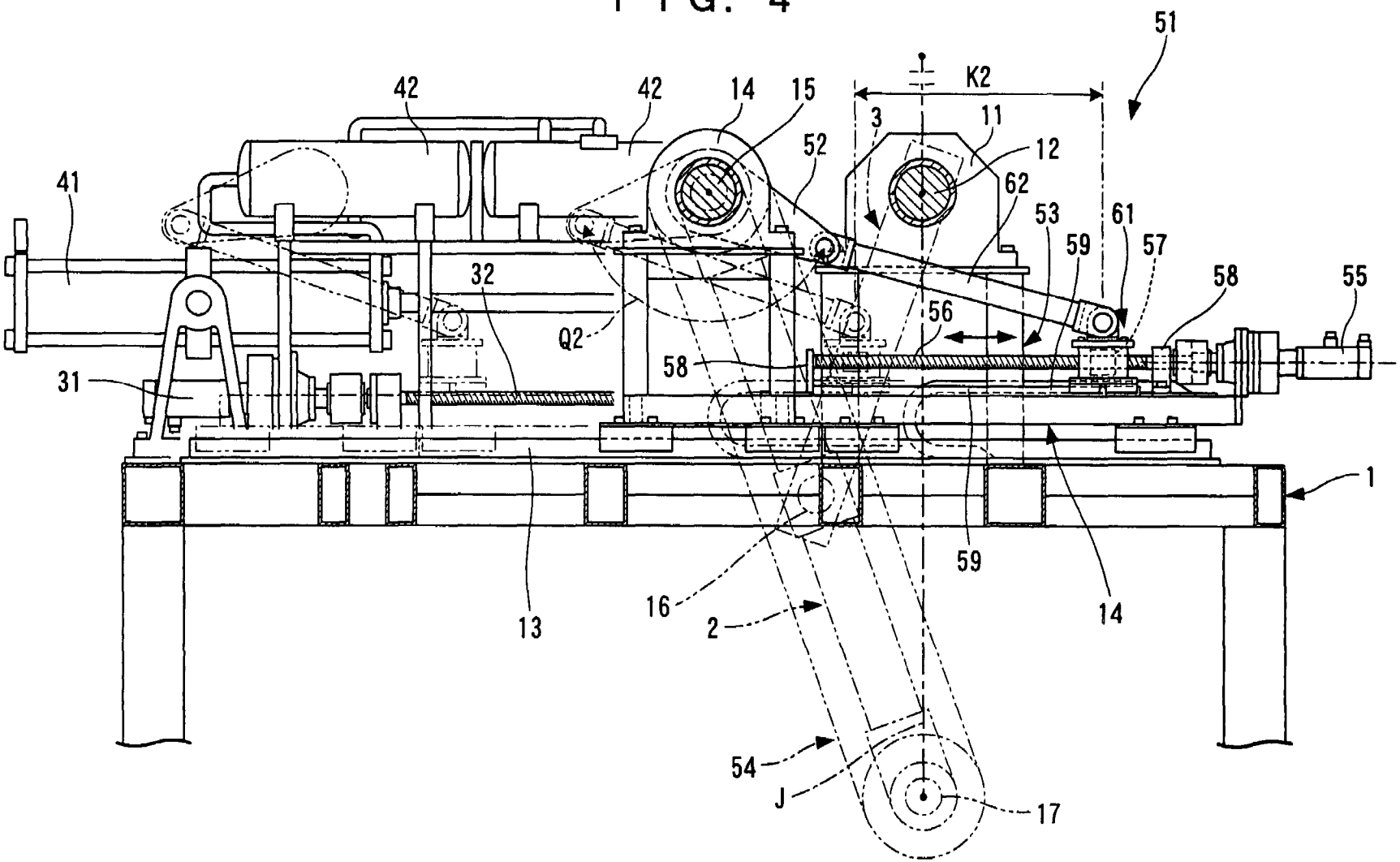
FIG. 4 is a cross-sectional view along I-I in FIG. 2.
Figure 5:
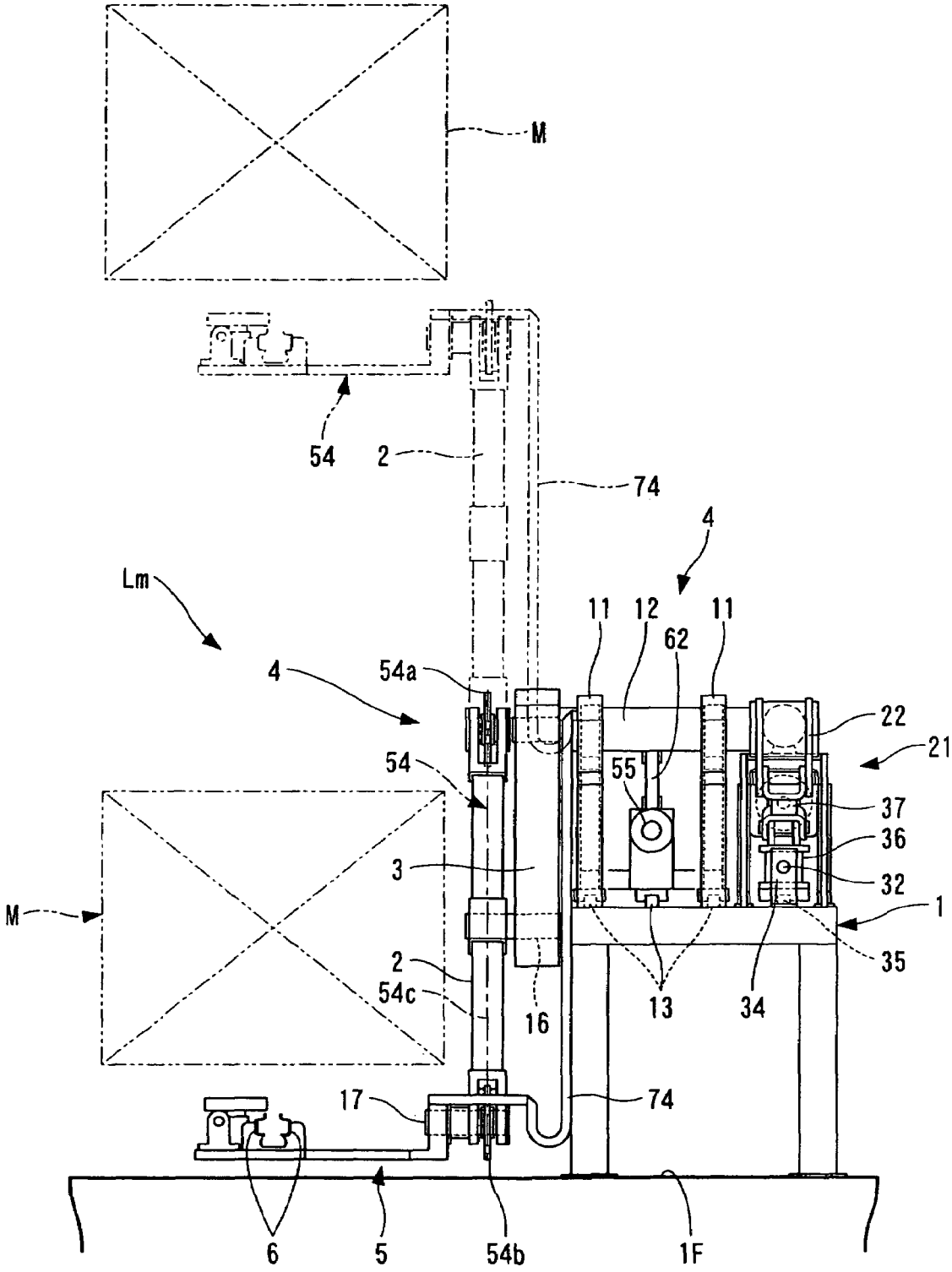
FIG. 5 is a general side view of the elevating transport apparatus.

Thus, as shown in FIGS. 2 to 4, the arm drive apparatus 21 is composed of a first passive lever 22 for elevating that is provided in a protruding condition on the first support shaft 12, a screw-type first linear drive apparatus (linear drive apparatus) 23 installed on the stand 1 and causing the first passive lever 22 to rotate, and an elevating aid apparatus 24 of a pressure accumulation type that aids the rotation of the first support shaft 12.

As for the first linear drive apparatus 23, the free end portion of the first passive lever 22 is connected and operably linked via a female traded member 33 to a first ball threaded shaft 32 that is rotary driven by a rotary drive apparatus 31 for elevating. More specifically, the first linear drive apparatus 23 comprises bearing members 34, 34 installed on the stand 1 with the prescribed spacing in the transport line (L1, L2) direction on the rear portion side of the stand 1, a first ball threaded shaft 32 in the horizontal direction rotatably supported between the bearing members 34, 34, a first movable body 36 having the female threaded member 33 engaged with the first ball threaded shaft 32 and guided so as to be free to move along the guide rail 35 of the stand 1, a first intermediate link bar 37 rotatably connected via a horizontal pin between the free end portion of the first passive lever 22 and the first movable body 36, and the rotary drive apparatus 31 for elevating that is connected to one end portion of the first ball threaded shaft 33 and rotary drives the first ball threaded shaft 33.

Therefore, if the first ball threaded shaft 32 is rotated by the rotary drive apparatus 31 for elevating, the first movable body 36 will move reciprocally within the range of stroke K1 in the transport line direction via the female threaded member 33 engaged with the first ball threaded shaft 32. Further, the first passive lever 22 is reciprocally rotated within the range Q1 (=θ degrees) indicated by the solid line and virtual line by the first movable body 36 via the first intermediate link bar 37 and the swing arm 3 is rotated via the first support shaft 12 connected to the first passive lever 22.

Further, if the swing arm 3 turns through the angle θ within an A-B interval, the first support shaft 12 will move along the linear trajectory I. At the same time the crank arm 2 will rotate via the first support shaft 12 and the free end support shaft 17 will be elevated within a C-D interval along the elevating transport line J. As a result, the movable transport rail apparatus 5 is elevated through the elevating stroke SA and the elevating rail 6 is displaced between the connection position of the lower transport rail R1 and the connection position of the upper transport rail R2.

Figure 6:
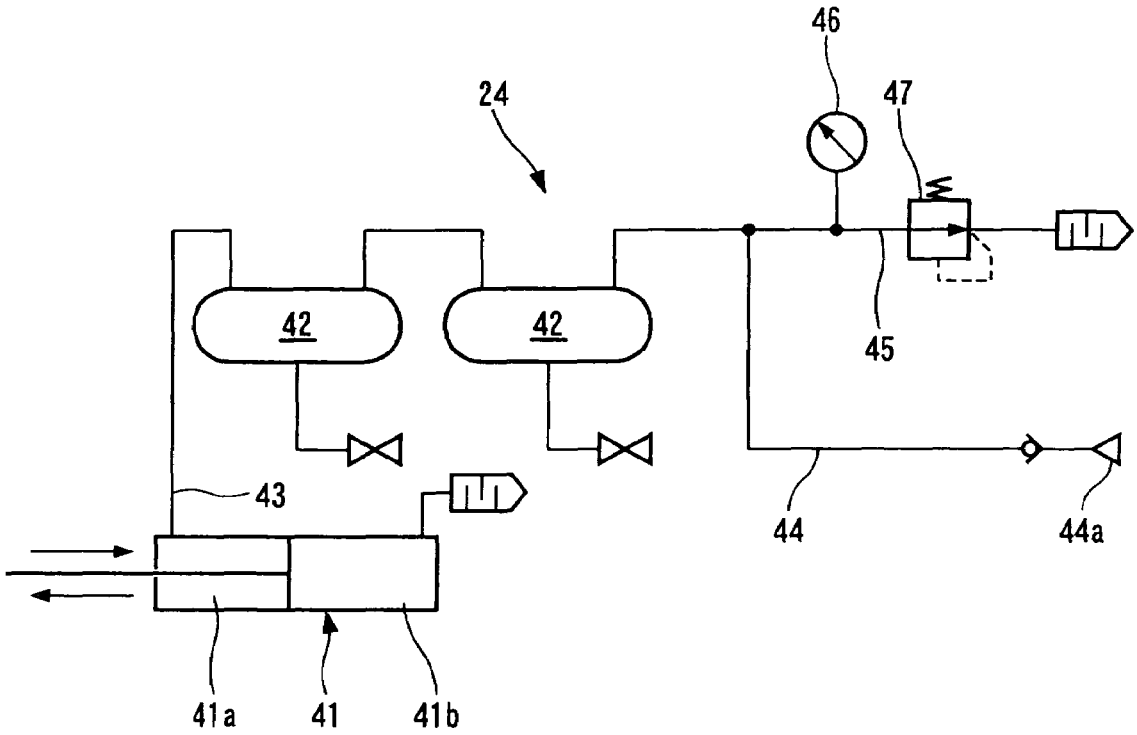
FIG. 6 is a structural drawing illustrating an elevating aid apparatus of the elevating transport apparatus.

As shown in FIG. 3 and FIG. 6, a pneumatic biasing cylinder 41 for rotary biasing the first support shaft 12 in the drive direction via intermediate members (first movable body 36, first intermediate link bar 37, first passive lever 22) and a pressure accumulation tank (pressure accumulator) 42 for supplying the air under the prescribed pressure to the biasing cylinder 41 are provided for reducing the load of the first linear drive apparatus 23 in the arm drive apparatus 21.

More specifically, the elevating aid apparatus 24 comprises the pneumatic biasing cylinder 41 with a piston rod 41*a* linked to the first movable body 36 and the pressure accumulation tank (pressure accumulator) 42 for supplying the air under the prescribed pressure to the biasing cylinder 41, an air supply pipe 43 connected to the pressure accumulation tank 42 is connected to a reduction chamber 41*a* of the biasing cylinder 41, and the expansion chamber 41*b* of the biasing cylinder 41 is open to the atmosphere via a noise absorber. Further, a pressure replenishment pipe 44 for supplying the air from a port 44*a* via a unidirectional restrictor valve is connected to the pressure accumulation tank 42. A pressure meter 46 for detecting the air pressure in the pressure accumulation tank 42, a safety valve 47 for maintaining the air pressure in the pressure accumulation tank 42 at the prescribed level, and a noise absorber installed in the release opening are provided in the air release pipe 45 connected to the pressure replenishment pipe 44.

As a result, if the air pressure in the pressure accumulation tank 42 detected by the pressure meter 46 is less than the prescribed pressure, an air supply unit (not shown in the figure) is actuated and the air is replenished by supplying from the port 44*a* to the pressure accumulation tank 42. Therefore, under the effect of the air pressure of the pressure accumulation tank 42, the biasing cylinder 41 is driven and, via the first movable body 36, the second support shaft 15 is rotationally biased in the direction of raising the movable transport rail apparatus 5.

A posture adjustment apparatus 51 for maintaining the horizontal posture of the movable transport rail apparatus 5 via the free end support shaft 17 comprises, as shown in FIG. 4, a second passive lever 52 provided in a protruding condition on the second support shaft 15, a second linear drive apparatus 53 for rotating the second passive lever 52, and a transmission apparatus 54 for posture adjustment that is installed on the crank arm 2.

The second linear drive apparatus 53 comprises a second ball threaded shaft 56 rotary driven by a posture adjustment drive apparatus 55, and a free end section of the second passive lever 52 is linked via a second female threaded member 57 to the second ball threaded shaft 56. More specifically, the second linear drive apparatus 53 is composed of the second ball threaded shaft 56 in the transport line direction that is rotationally supported between bearing members 58, 58 attached to the base portion of the movable bearing member 14, a second movable body 61 having the female threaded member 57 engaged with the second ball threaded shaft 93 and movably guided by a guide rail 59 installed on the base portion of the movable bearing member 14, a second intermediate link bar 62 rotatably linked via horizontal pins between the free end portion of the second passive lever 52 and the second movable body 61, and the posture adjustment drive apparatus 55 linked to the rear end section of the second ball threaded shaft 93. As shown in FIG. 1, in the transmission apparatus 54 for posture adjustment, a chain 54*c* is wound on and stretched between a sprocket 54*a* mounted on the second support shaft 15 and a sprocket 54*b* mounted on the free end support shaft 17 and this chain links the second support shaft 15 and the free end support shaft 17.

Therefore, if the second ball threaded shaft 56 is rotated by the posture adjustment drive apparatus 55, the second movable body 61 moves via the female threaded member 60 within a K2 range shown by the solid line and virtual line in the front-back direction, the second passive lever 52 swings via the first intermediate link bar 62 on the second movable body 61 within a Q2 range, and the second support shaft 15 is rotated. Further, under the effect of the second support shaft 15, the free end support shaft 17 is rotated via the transmission apparatus 54 for posture adjustment and the movable transport rail apparatus 5 is maintained in the horizontal posture.

In the movable transport rail apparatus 5, as shown in FIG. 1 and FIG. 2, there is provided an elevating plate 71 having the free end support shaft 17 linked to the central portion on the back side thereof, and a pair of left and right elevating rails 6 are installed on the elevating plate 71 via support members for guiding the transport cart 7. Those elevating rails 6 can be connected to the lower transport rail R1 and upper transport rail R2, and the elevating rail 6 is formed to have a channel-like cross section with the open surfaces thereof disposed so as to face each other. Further, the movable transport rail apparatus 5 is provided with two pressure rollers 72*a* located via the prescribed spacing in the transport direction, a running drive apparatus 72 of a pressure roller system that is composed of a running drive motor 72*b* for rotary driving those pressure rollers 72*a*, and a cable gear 74 connected between the stand 1 and the elevating plate 71 for supplying power to the rotary drive motor 72*b* or transmitting and receiving the detection signals. Further, linking units 73A, 73B for positioning and fixing the respective elevating rails 6 are installed at the connection ends of the lower transport rail R1 and upper transport rail R2. Those linking units 73A, 73B comprise a positioning pin 73*a* on the fixing side, a pin withdrawal cylinder 73*b* for withdrawing the pin, and a pin receiving member 73*c* enabling the positioning pin 73*a* to fit into and be removed from the elevating plate 71.

Figure 7:
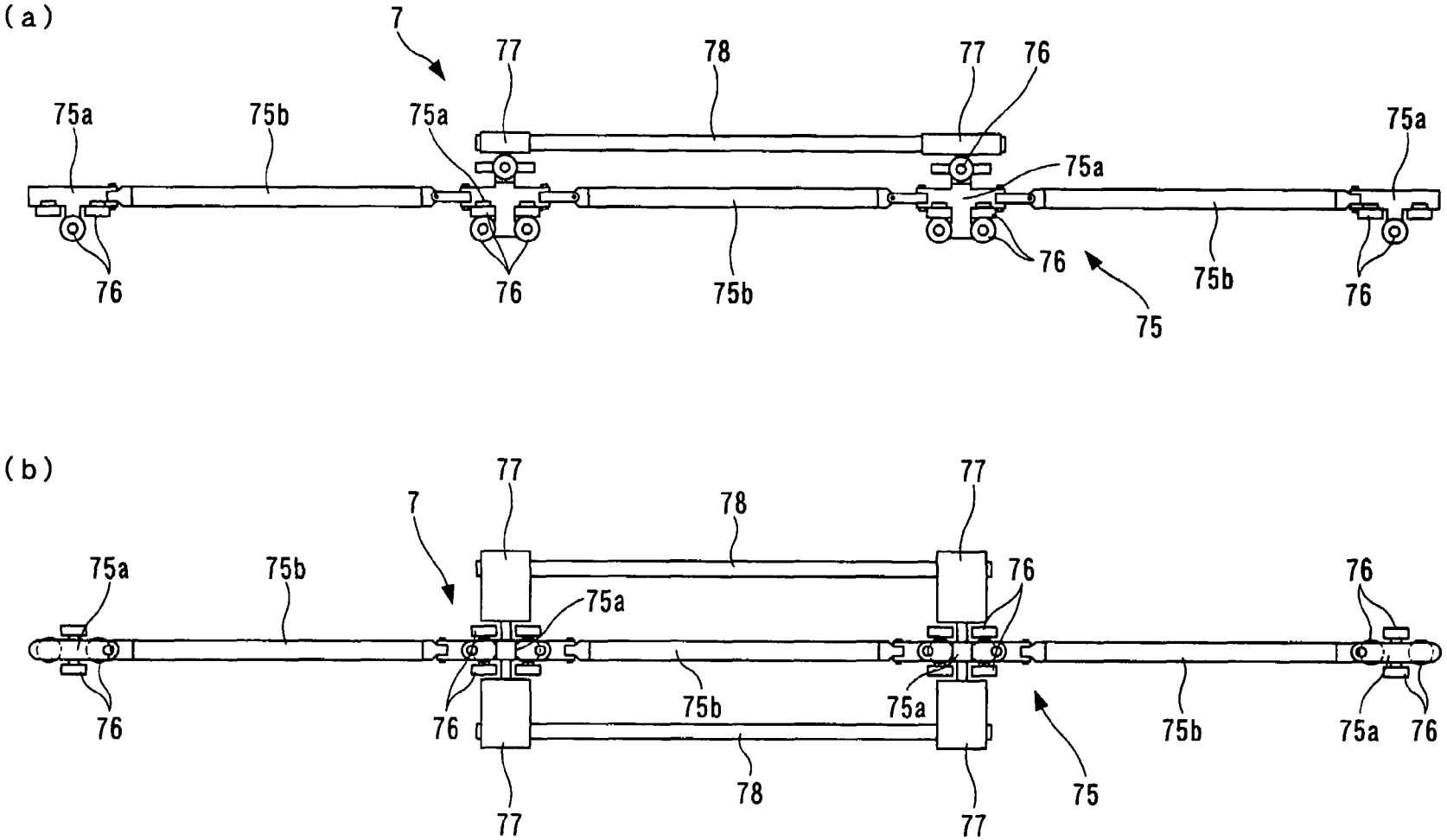
FIG. 7 shows a transport cart of the elevating transport apparatus; (*a*) being a side view and (*b*) being a plan view.

In the transport cart 7, a cart body 75 is formed, as shown in FIG. 7, by a plurality (four in the figure) wheel support bodies 75*a* having traveling wheels 76 and a plurality of connection links 75*b* linking the wheel support bodies 75*a* to each other so that they can be freely bent in the up-down direction and left-right direction. Further, on the left and right sides of the cart body 75, a plurality of sets of traveling wheels 76 are fit, so that they can move therein, in the opening portions of the elevating rails 6. Moreover, the cart body 75 is disposed so that it can move between the elevating rails 6 via the traveling wheels 76, and the pressure roller 72*a* of the traveling drive apparatus 72 is abutted against one side surface of the wheel support bodies 75*a* and connection links 75*b* and is driven so as to move thereon. The two wheel support bodies 75*a* in the intermediate positions are provided with respective pairs of left and right load-receiving stands 77 for supporting the body M to be transported, and the front and rear load-receiving stands 77 are linked together by the linking members 78.

Figure 8:
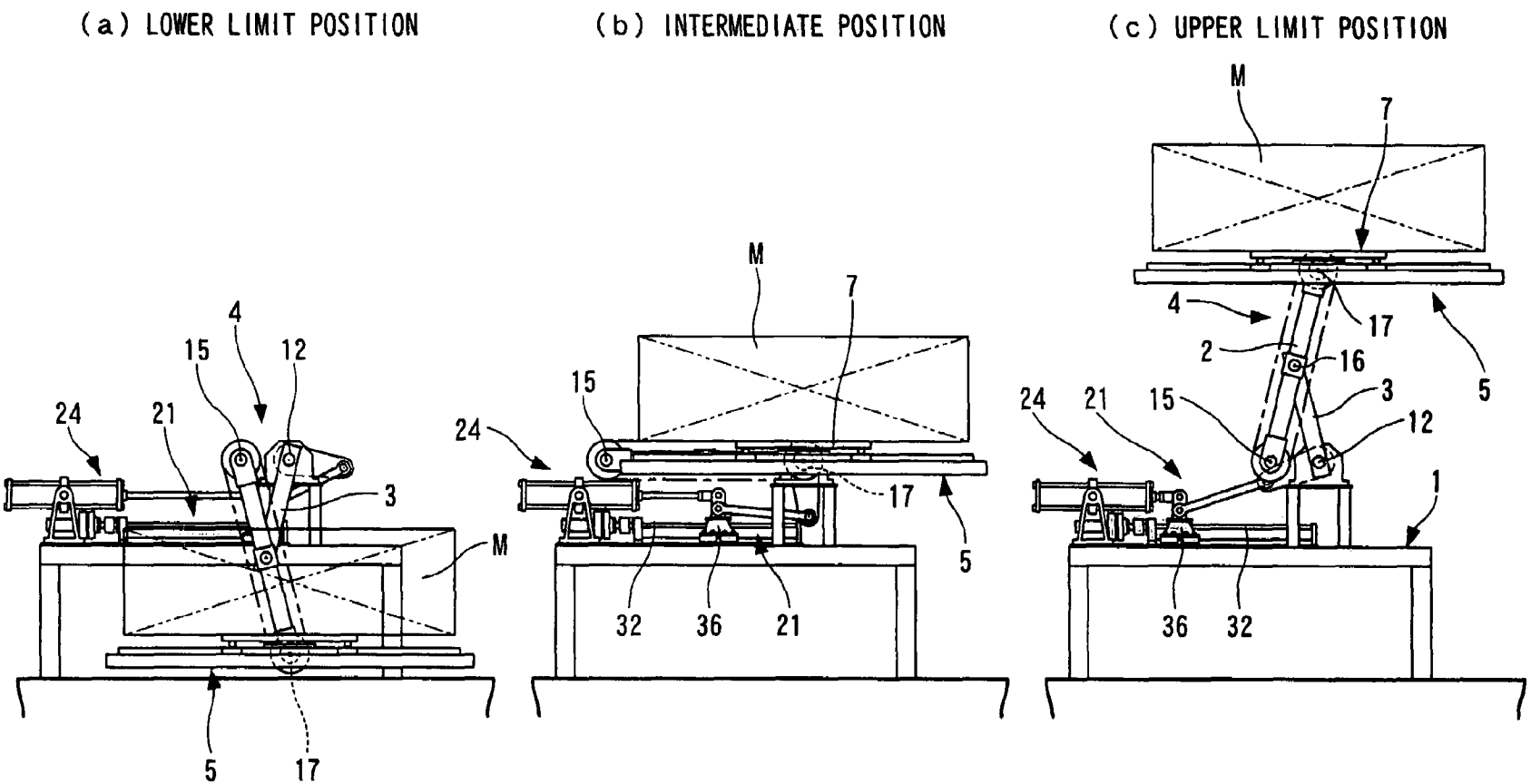
FIG. 8 shows front views illustrating elevating operations of the elevating transport apparatus, respectively, in (*a*)-(*c*)

In the above-described configuration, the transport cart 7 carrying the body M to be transported, is guided by the lower transport rail R1, moved along the lower transport line L1, moved on the elevating rail 6, and stopped. As a result, after a connection apparatus 73A has been released, the first linear drive apparatus 23 is driven, the first support shaft 12 is rotated via the first passive lever 22, the swing arm 3 and crank arm 2 are rotated, and the movable transport rail apparatus 5 is raised, as shown in FIGS. 8A-C from the connection position of the lower transport rail R1 to the connection position of the upper transport rail R2. Then, a connection apparatus 73B is actuated, the elevating rails 6 and upper movable rails R2 are linked together, and the transport cart 7 is then moved forward from the elevating rail 6 and caused to travel along the upper transport line L2. It goes without saying that the transport cart 7 carrying the body M to be transported, can be transferred from the upper transport line L2 to the lower transport line L1 by the reversed procedure.

With the above-described Embodiment 1, the crank arm 2 rotates in the up-down direction about the second support shaft 15. Therefore, the elevation stroke SA of the movable transport rail apparatus 5 can be set to a large length, at maximum to an almost two-fold length of the crank arm 2. Therefore, the crank arm 2, which is the member determining the longitudinal dimension of the elevating transport apparatus, can be sufficiently shorter than the elevation stroke SA. As a result, handling of the crank arm 2 and truck transportation thereof from the manufacturing plant to the installation site (construction site) can be easily conducted and the transportation cost can be greatly reduced.

Further, the movable transport rail apparatus 5 can be elevated via the free end support shaft 17 along the vertical trajectory I or along a trajectory in an almost vertical direction by using a setting S1:S2:S3=1:1:1 or S1:S2:S3≈1:1:1 where S1 is the length of the crank arm 2 from the second support shaft 15 to the connection shaft 16, S2 is the length of the crank arm 2 from the connection shaft 16 to the free end support shaft 17, and S3 is the length of the swing arm 3 from the first support shaft 12 to the connection shaft 16. As a result, a contribution can be made to the reduction of the installation space and shortening of the transport time.

Furthermore, the configuration of the arm drive apparatus 21 is such that the free end section of the first passive lever 22 is pushed out and the first support shaft 12 is rotated by the first linear drive apparatus 23 and the crank arm 2 is rotated via the swing arm 3. Therefore, in the case where the above-described arm drive apparatus 21 is (3)[(3a)-(3c)], in the course of linear movement, the movement trajectory should be bent in the inflection points, but in this case smooth elevating transport can be implemented by unidirectional operation from the lower limit to the upper limit.

Further, because the drive force of the first linear drive apparatus 23 can be enhanced by the elevating aid apparatus 24 having the pressure accumulation tank 42 and biasing cylinder 41, the load on the rotary drive apparatus 31 for elevating can be reduced. Therefore, the adjustment is facilitated and the entire structure can be made more compact than in the case of the aid apparatus using, e.g., a counterweight of the conventional example.

Further, with respect to the free end support shaft 17 that changes the posture (angular position) thereof following the rotation of the crank shaft 2, the second linear drive apparatus 53 is actuated by the posture adjustment apparatus 51, the angular position of the free end support shaft 17 is adjusted via the second passive lever 52, second support shaft 15, and transmission apparatus 54, the posture of the movable transport rail apparatus 5 can be randomly adjusted and maintained, and stable elevating transport can be conducted.

Furthermore, elevating the movable transport rail apparatus 5 and elevating and transporting the transport cart 7 carrying the body M to be transported, makes it possible to move the transport cart 7 continuously between the transport paths L1, L2, and the transport of the body M to be transported, can be smoothly conducted.

Embodiment 2

Figure 9:
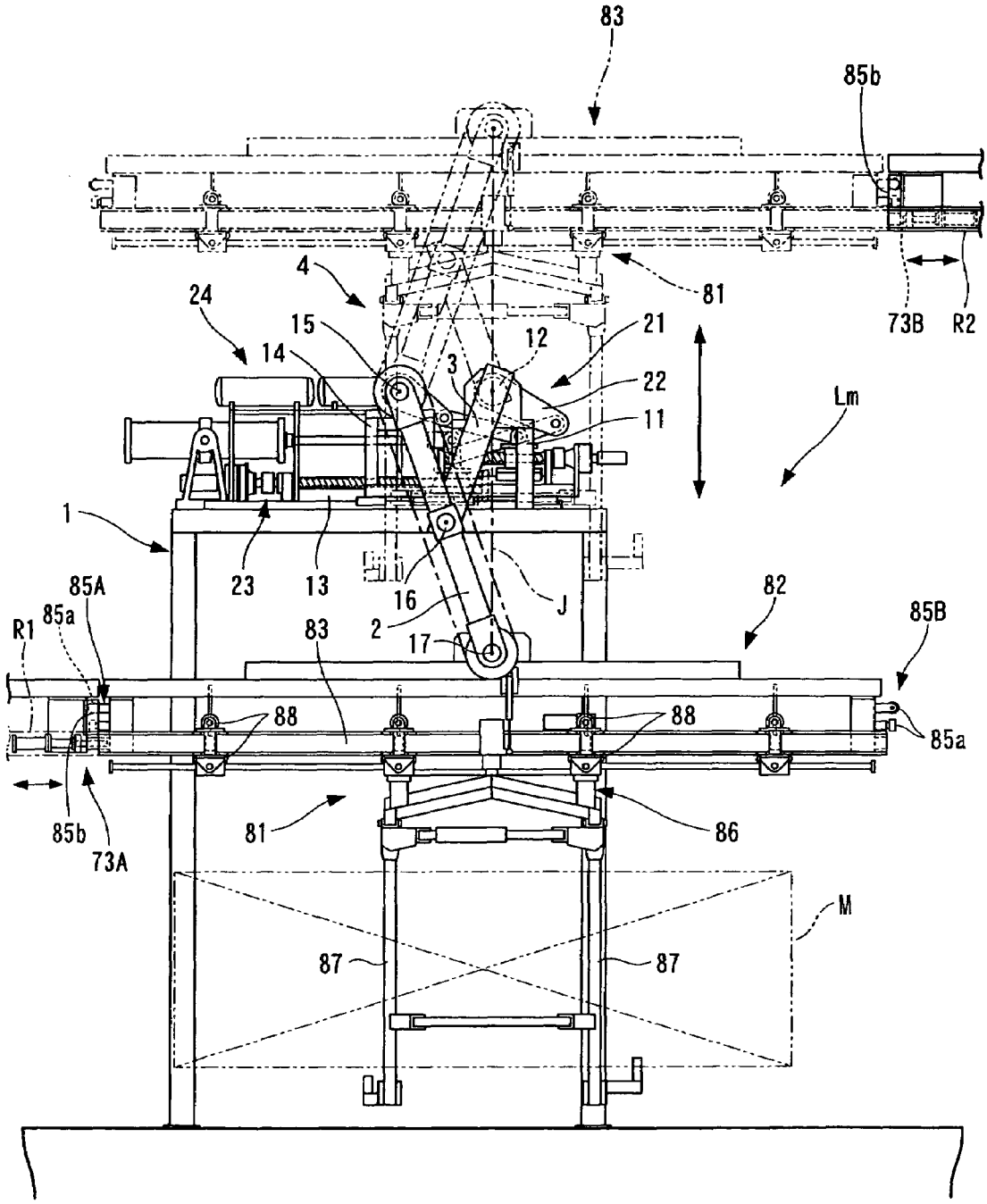
FIG. 9 is a general front view illustrating Embodiment 2 of the elevating transport apparatus in accordance with the present invention.
Figure 10:
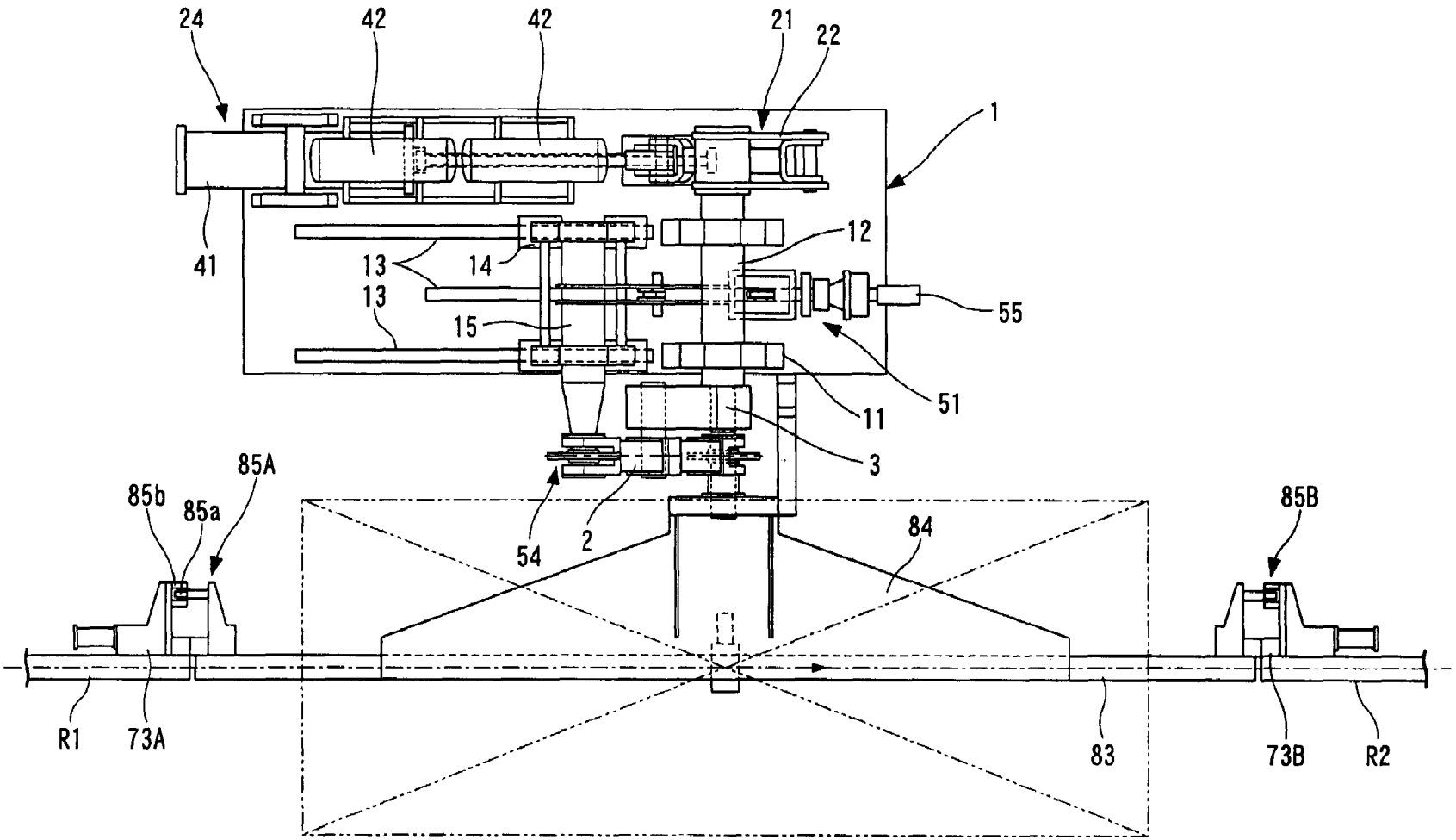
FIG. 10 is a general plan view of the elevating transport apparatus.
Figure 11:
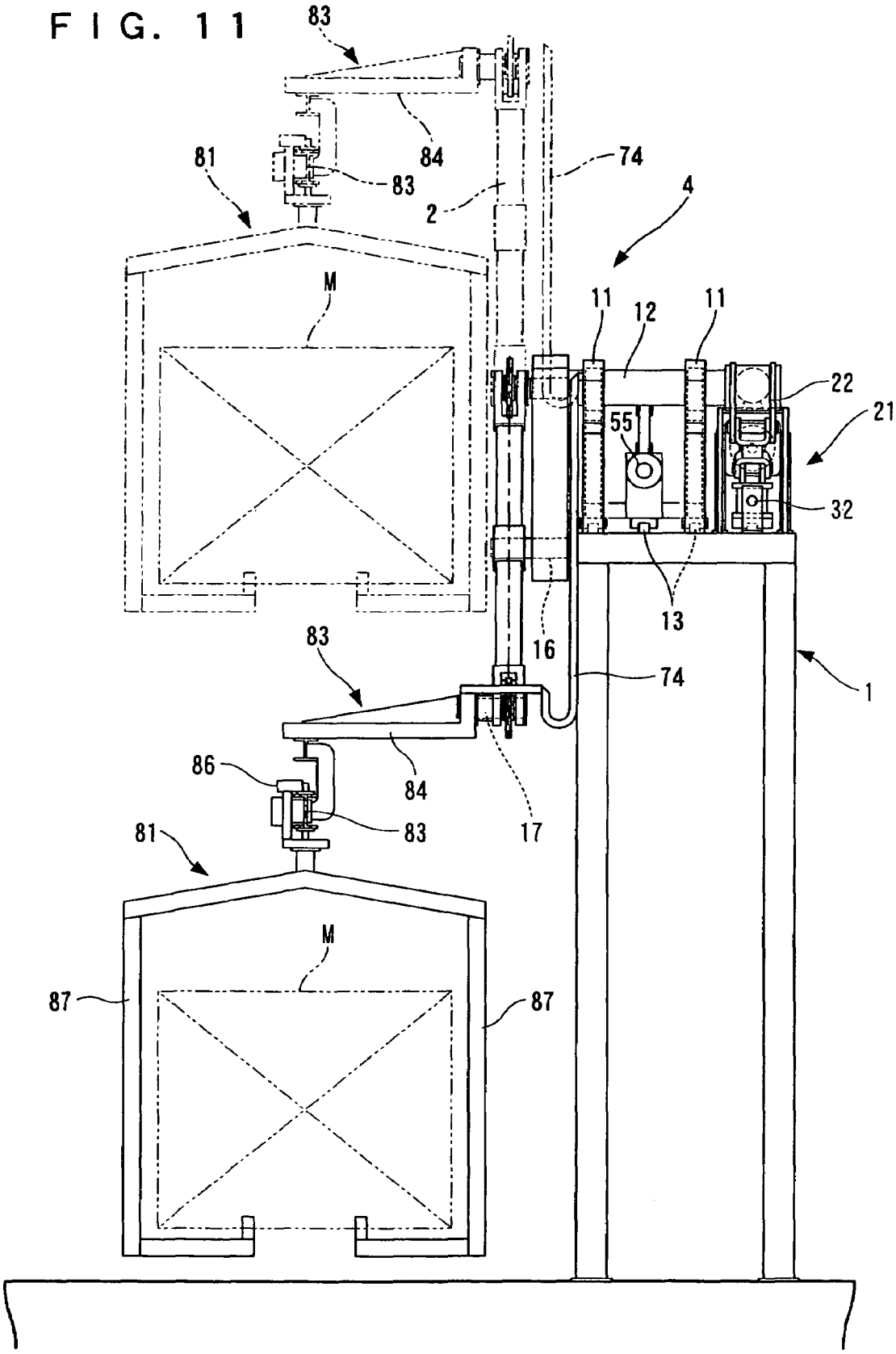
FIG. 11 is a general side view of the elevating transport apparatus.

The explanation will be conducted with reference to FIGS. 9 to 11. Components identical to those of Embodiment 1 are assigned with the same reference symbols and the explanation thereof is herein omitted.

In Embodiment 2 a suspension-type transport machine 81 that can move when guided by rails R1, R2 and elevating rail 83 is employed instead of the transport cart 7 of Embodiment 1.

Thus, a movable transport rail apparatus 82 having an elevating rail 83 is provided on the free end section of the crank arm 2 of the elevating transport apparatus 4.

In the movable transport rail apparatus 82, an elevating rail 83 with an I-shaped cross section is supported via a suspension member on a support plate 84 fixed to the free end support shaft 17. Furthermore, guide apparatuses 85A, 85B and connection apparatuses 73A, 73B for positioning and fixing the elevating rail 83 in the lower limit position and upper limit position are provided at the front and rear end portions of the support plate 84 in the transport line direction and at the end portion of the lower transport rail R1 and upper transport rail R2.

The guide apparatuses 85A, 85B are composed of positioning rollers 85*a* provided at the front and rear end portions of the support plate 84 and guiding parts 85*b* provided at the end portions of the lower transport rail R1 and upper transport rail R2 and so that the positioning rollers 85*a* can be fit therein and removed therefrom.

The suspension-type transport machine 81 comprises a traveling body 86 that is suspended and supported so that it can freely move on the elevating rail 83 via a plurality of traveling wheels 88, and two, front and rear, hanger arms 88 in a left and right pair that expand to both sides from the traveling body 86 to support the body M to be transported, from below.

With this configuration, the operation effect identical to that of Embodiment 1 can be demonstrated.

Embodiment 3

Figure 12:
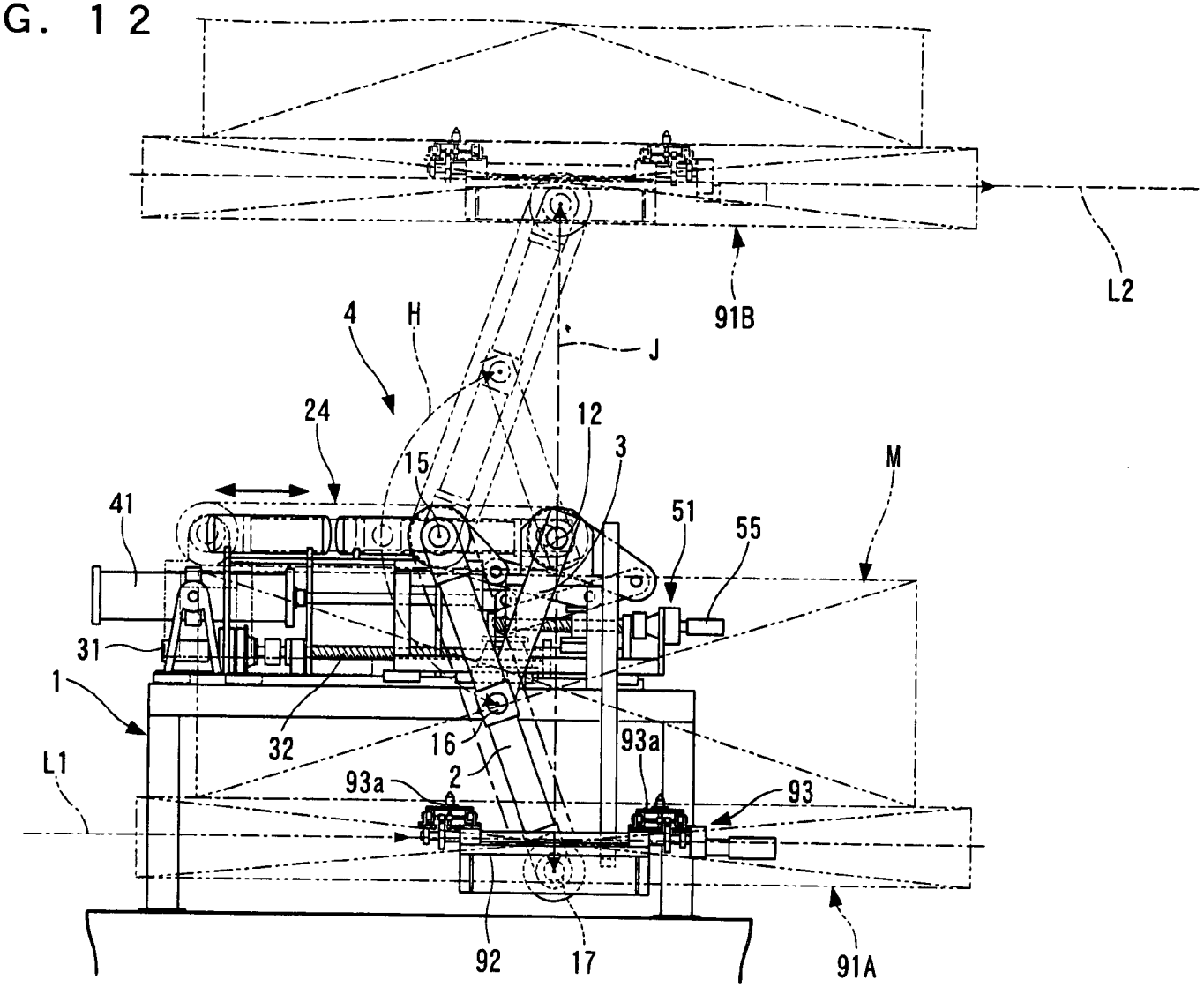
FIG. 12 is a general front view illustrating Embodiment 3 of the elevating transport apparatus in accordance with the present invention.
Figure 13:
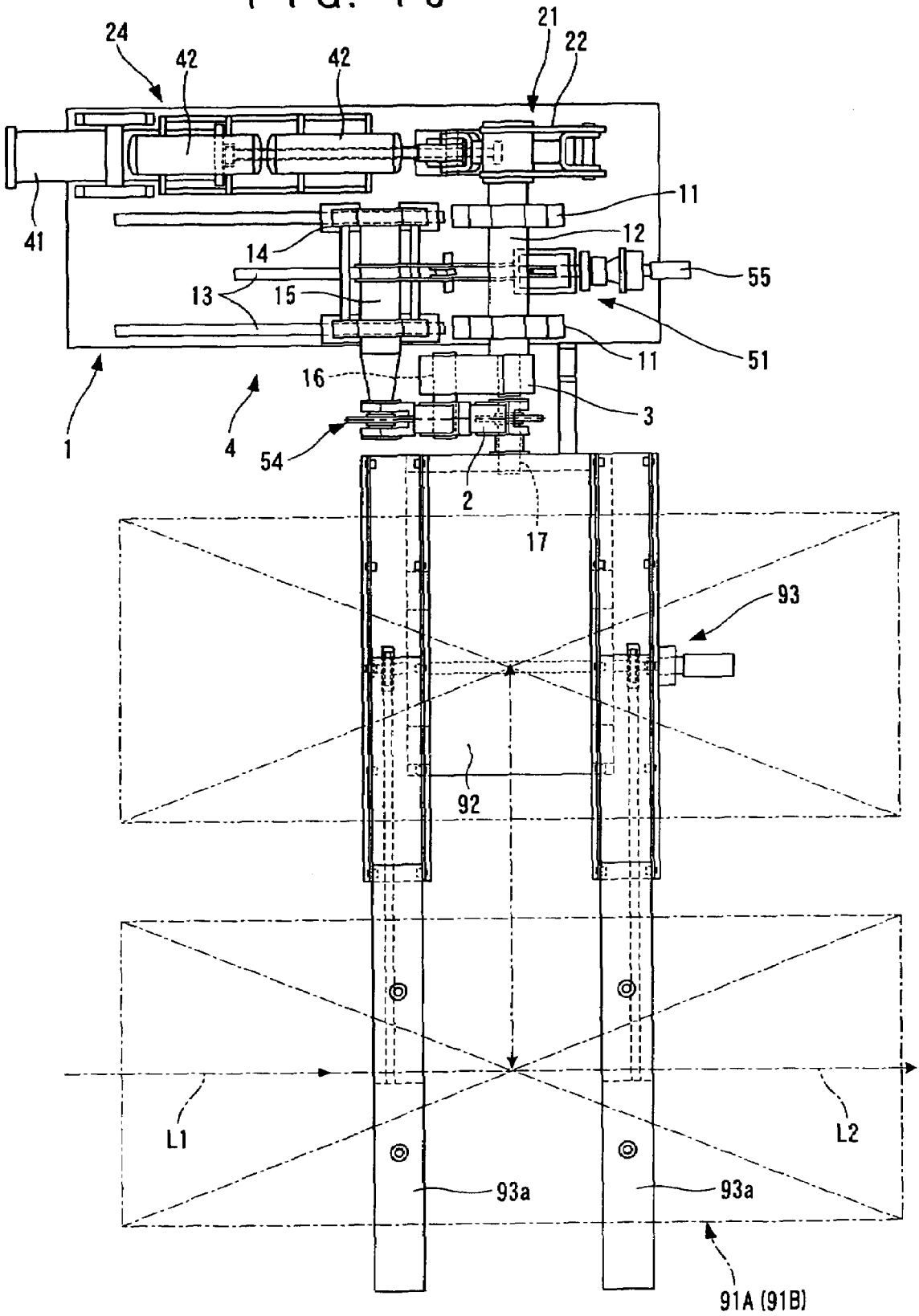
FIG. 13 is a general plan view of the elevating transport apparatus.
Figure 14:
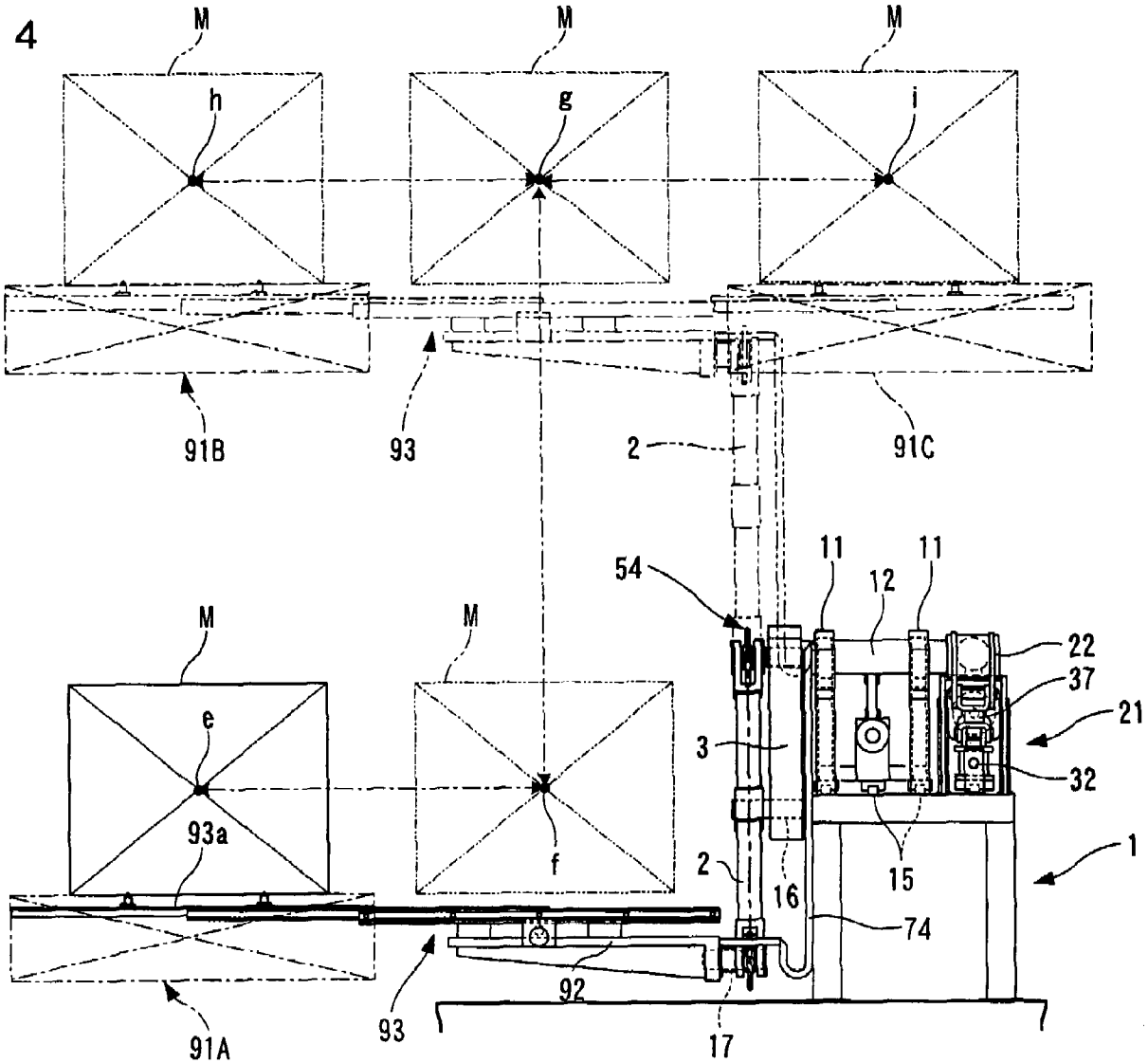
FIG. 14 is a general side view of the elevating transport apparatus.

The explanation will be conducted with reference to FIGS. 12 to 14. Components identical to those of Embodiment 1 are assigned with the same reference symbols and the explanation thereof is herein omitted.

In Embodiments 1 and 2, movable transport rail apparatuses 5, 82 were provided as transport body support means.

By contrast, in Embodiment 3, the transport machines 91A, 91B are disposed so that they can move on the lower transport line L1 and upper transport line L2, respectively, and a transfer apparatus capable of transferring the body M that is carried on the transport machines 91A, 91B is provided as transport body support means.

Thus, this transfer apparatus is configured of a fork apparatus 93 of a telescopic type that has withdrawing members 93*a* that can be freely withdrawn in three stages, front, and rear, in left and right pairs on the support plate 92 fixed to the free end support shaft 17. A rack-and-pinion mechanism or wire suspension mechanism (not shown in the figure) can be employed as the withdrawal drive mechanisms of the protrusion/withdrawal members 93*a* in the fork apparatus 93.

The transfer machines 91A, 91B have a space into which the protrusion/withdrawal member 93*a* of the fork apparatus 93 can be inserted below the body M to be transported. Further, the stop positions of the transport machines 91A, 91B on the lower transport line L1 and upper transport line L2, that is, the delivery positions e, h, are set in front of the lower limit position and upper limit position in the point-of-origin positions (retraction positions) f, g of the protrusion/withdrawal member 93*a*.

Therefore, if the transport machine 91A carrying the body M to be transported, moves along the lower transport line L1 and stops in the lower delivery position e, then the fork apparatus 93 of the elevating transport apparatus 4 is driven and the protrusion/withdrawal member 93*a* is protruded and inserted into the above-described space of the transport machine 91A located below the body M to be transported. The fork apparatus 93 is then raised through the prescribed distance by the arm drive apparatus 21 and the body M to be transported, is received on the protrusion/withdrawal member 93*a*. Then, the protrusion/withdrawal member 93*a* is retracted by the fork apparatus 93 and returned from the lower delivery position e to the lower point-of-origin position f.

Further, the fork apparatus 93 is raised by the arm drive apparatus 21 and stopped in the upper-limit upper point-of-origin position g, and then the fork apparatus 93 is driven and the protrusion/withdrawal member 93*a* protrudes toward the empty transport machine 91B till it reaches the upper delivery position h. The body M is then delivered to the transport machine 91B of the upper transport line L2 by lowering the fork apparatus 93 through the prescribed distance by the arm drive apparatus 21.

In the fork apparatus 93, after the protrusion/withdrawal member 93*a* has been retracted to the point-of-origin position, the transport machine 91B moves along the upper transport line L2. In the case of a telescopic-type fork apparatus 93, a structure can be employed in which the protrusion/withdrawal member 93*a* can be retracted backward. As a result, the protrusion/withdrawal member 93*a* can be retracted to the upper retraction position i and the body M can be delivered to the transport machine 91C.

With the above-described embodiment, the effect identical to that of the earlier embodiments can be demonstrated. In addition, the body M to be transported, can be directly transferred between the transport machines 91A, 91B that move along the transport lines L1, L2 of different heights by the fork apparatus 93.

Embodiments 4 to 8 of an elevating transport apparatus for elevating and transferring the body M to be transported, between a transport route and a processing and working position located at different heights will be described below.

Embodiment 4

Figure 15:
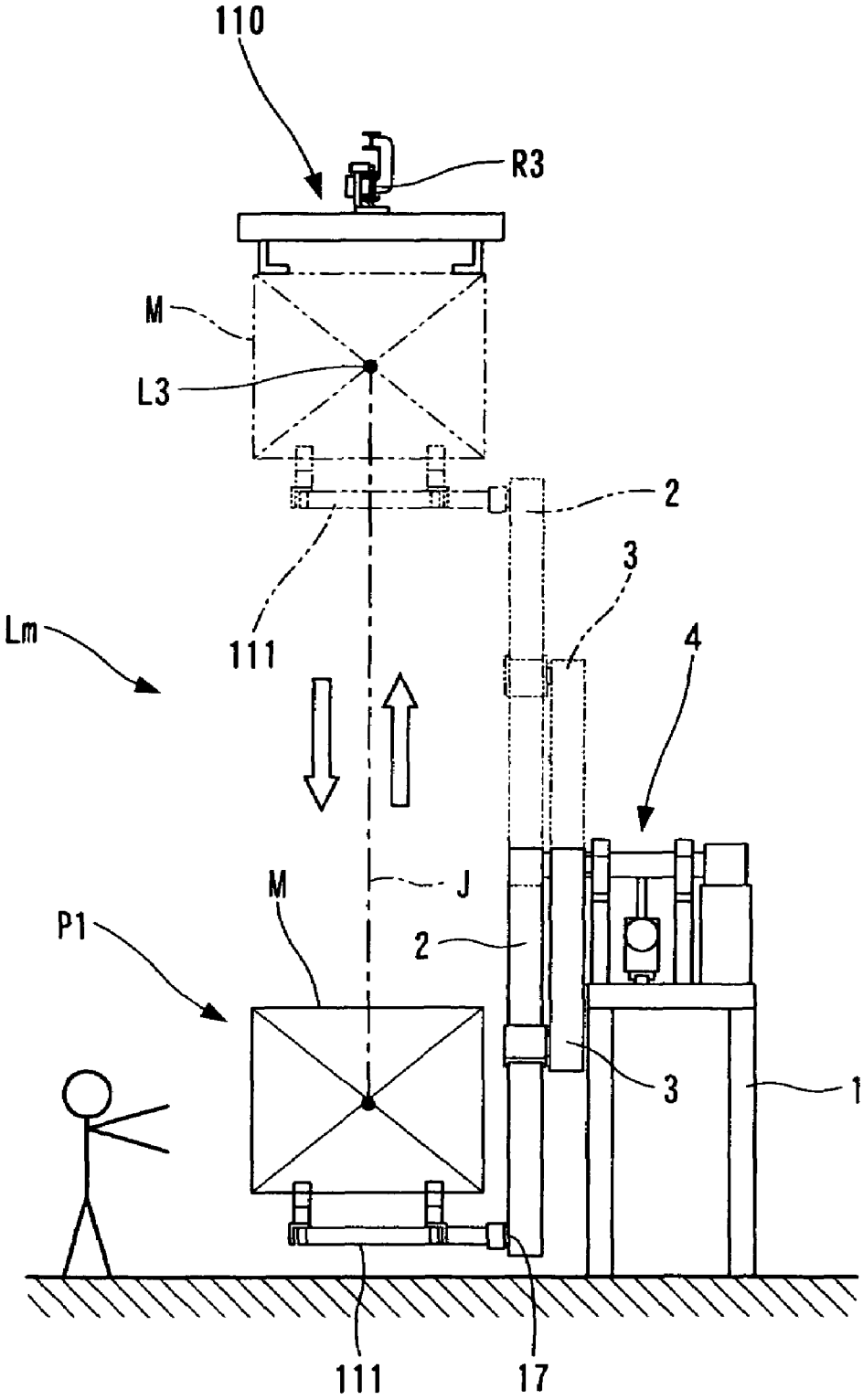
FIG. 15 is a general front view illustrating Embodiment 4 of the elevating transport apparatus in accordance with the present invention.

Embodiment 4 will be described below with reference to FIG. 15. Components identical to those of the previously described embodiments are assigned with the same reference symbols and the explanation thereof is herein omitted.

In this equipment, there are provided a suspension-type transport machine 110 guided by a transport rail R3 installed along an upper transport rail (transport route) L3 and a lower processing and working position P1 disposed below the upper transport line L3.

An elevating transport apparatus 4 identical to that of the previously described embodiments is installed on the stand 1 in a space of an elevating section Lm between the upper transport line L3 and processing and working position P1. A load-receiving member (transport body support apparatus) 111 whose posture can be adjusted by the posture adjustment apparatus 51 via the free end support shaft 17 is provided at the free end section of the crank arm 2 of the elevating transport apparatus 4.

Therefore, the body M that was supplied by the suspension-type transport machine 110 is received on the load-receiving member 111 in the raised position of the elevating transport apparatus 4, the elevating transport apparatus 4 is driven, and the body M is lowered along the elevating transport line J to the lower processing and working position P1. In the lower processing and working position P1, the member and part assembly, disassembly, and cleaning processing necessary for the body M are conducted manually or with special mechanisms by an operator or by an industrial robot. At this time, the body M can be adjusted with the posture adjustment apparatus 51 via the load-receiving member 111 to any work and processing posture.

After the processing, the body M to be transported, is raised from the lower processing and working position P1 to the upper transport line L3 along the elevating transport line J by driving the elevating transport apparatus 4 and delivered from the load-receiving member 111 to the suspension-type transport machine 110. The suspension-type transport machine 110 is then driven and transported along the upper transport line L3.

Here, the body M to be transported, was delivered from the suspension-type transport machine 110 to the load-receiving member 111, elevated, and transported, but it is also possible, as in Embodiment 2, to provide a movable transport rail apparatus comprising elevating rails separated from the transport rail R3 and to elevate both the suspension-type transport machine 110 and the movable transport rail apparatus to the lower processing and working position P1.

With the above-described embodiment, providing the elevating transport apparatus 4 in accordance with the present invention in the space between the upper transport line L3 and the elevating section Lm of the lower processing and working position P1 provided therebelow makes it possible to remove the body M, which is being transported, from the upper transport line L3 and to operate or process the body.

This configuration has the following advantages over a pantograph-type lifter using the conventional parallel links that is generally used as the elevating transport apparatus.

(1) The number of links and arms is less and the number of rotary shafts as rotation centers thereof is less, provided the elevating stroke is the same, thereby facilitating assembling and accurate adjustment, reducing wear, and improving maintainability.

(2) No accommodation space is required on the floor for large drive units. Furthermore, because the space below the load-receiving member 111 is open, except when the load passes therethrough, the degree of freedom in equipment arrangement is high.

(3) The posture of the body, which is being transported, can be randomly adjusted and operability and processing performance in the lower processing and working position P1 can be improved.

Embodiment 5

Figure 16:
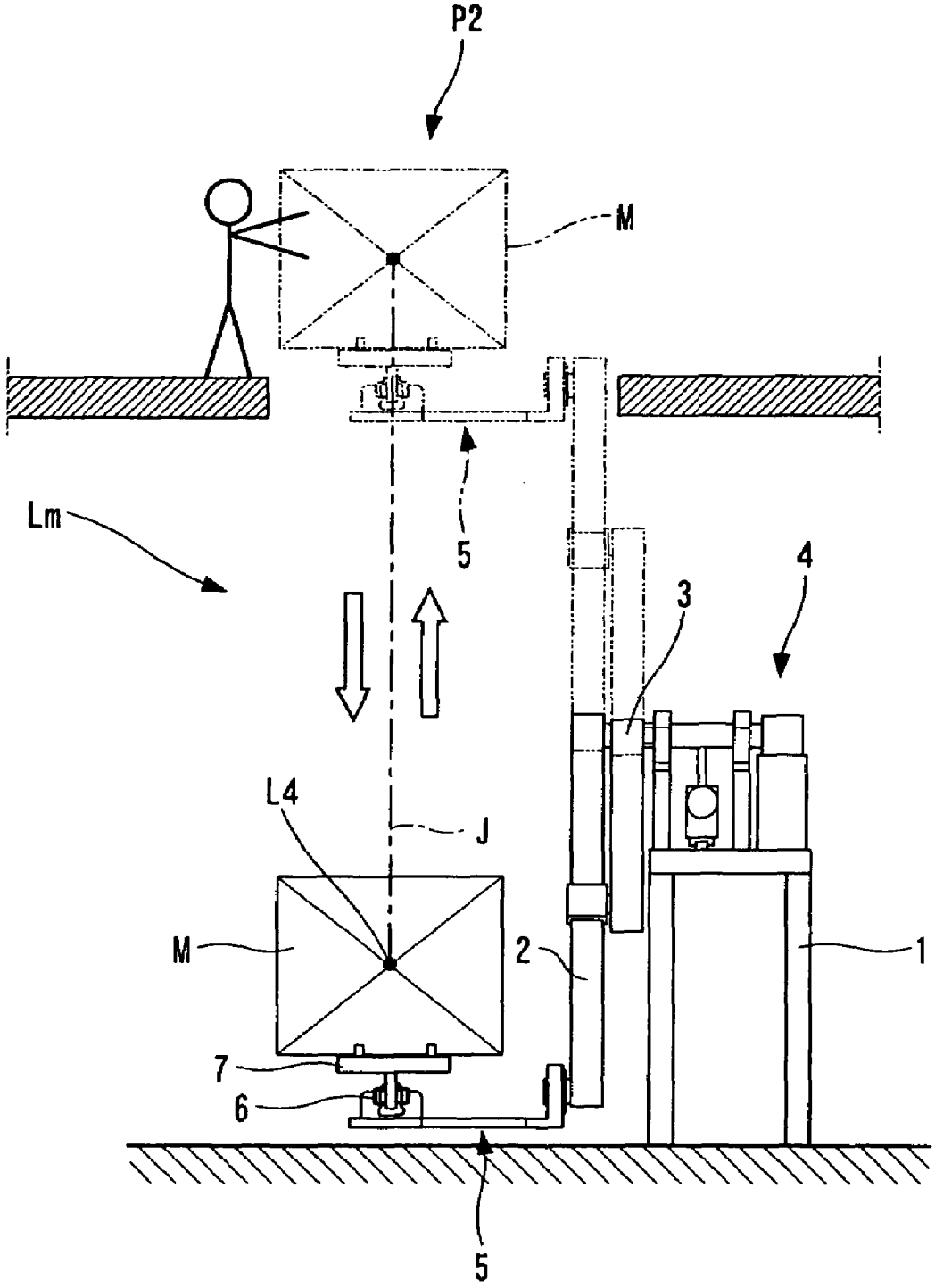
FIG. 16 is a general front view illustrating Embodiment 5 of the elevating transport apparatus in accordance with the present invention.

Embodiment 5 will be described below with reference to FIG. 16. Components identical to those of the previously described embodiments are assigned with the same reference symbols and the explanation thereof is herein omitted.

The elevating transport apparatus 4 is provided in the elevating space Lm between the lower transport line L4 and the upper processing and working position P2 provided in a position above the lower transport line L4. In Embodiment 5, the movable transport rail apparatus (transport body support means) 5 having an elevating rail 6 is provided via a suspending member 121 on the free end portion of the crank arm 2.

With Embodiment 5, the operation effect identical to that of Embodiment 4 can be demonstrated.

Embodiment 6

Embodiment 6 will be described below with reference to FIG. 17 and FIG. 18. Components identical to those of the previously described embodiments are assigned with the same reference symbols and the explanation thereof is herein omitted.

In Embodiment 6, a multistage fork apparatus 93 identical to that of Embodiment 3 is provided as transport body support means.

Figure 17:
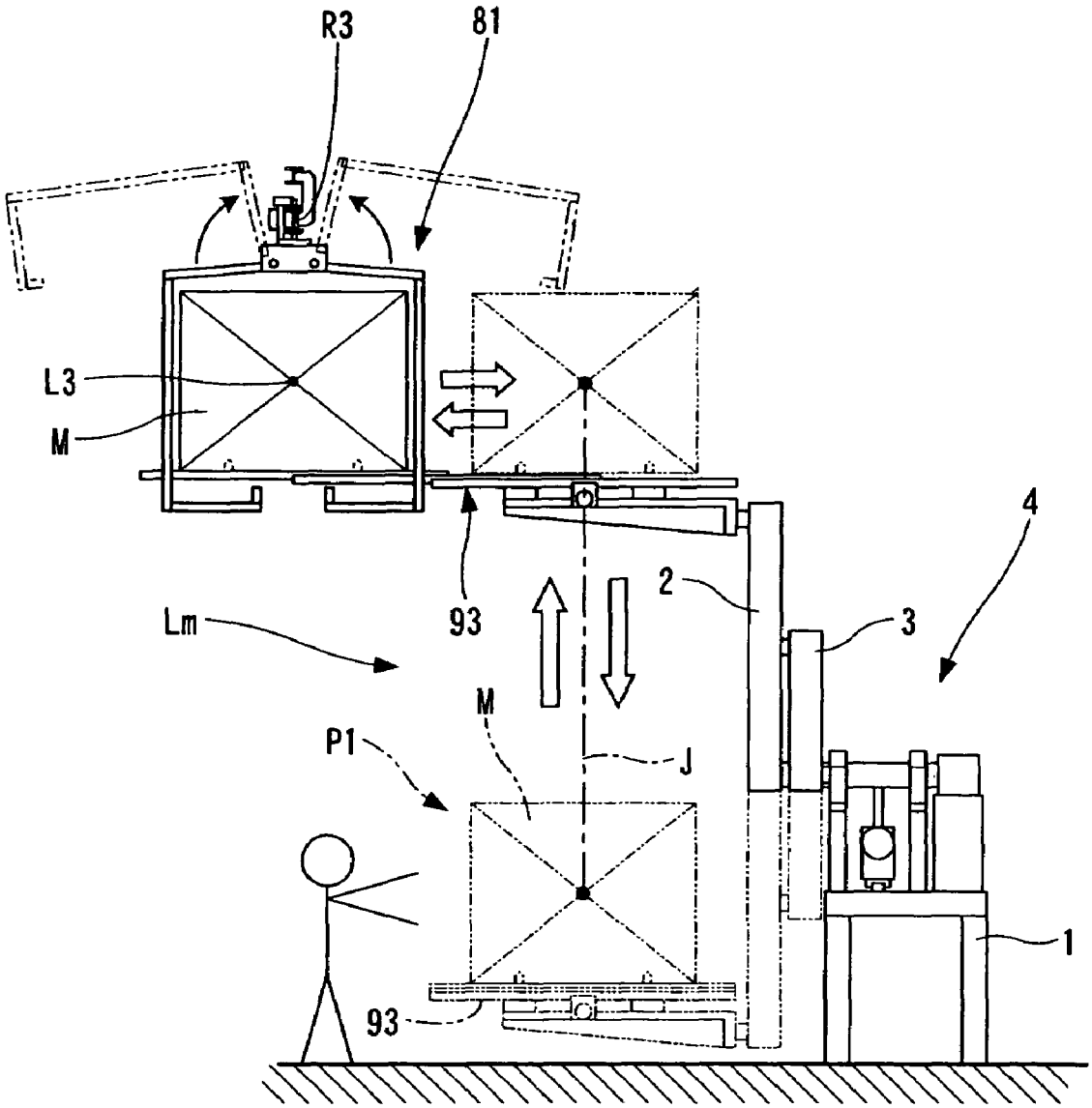
FIG. 17 is a general front view illustrating Embodiment 6 of the elevating transport apparatus in accordance with the present invention.

In the configuration shown in FIG. 17, the body M, which is transported with the suspension transport apparatus 81 disposed movably on the upper transport line L3, is received by the fork apparatus 93 of the elevating transport apparatus 4 and elevated and transported to the lower processing and working position P1.

Figure 18:
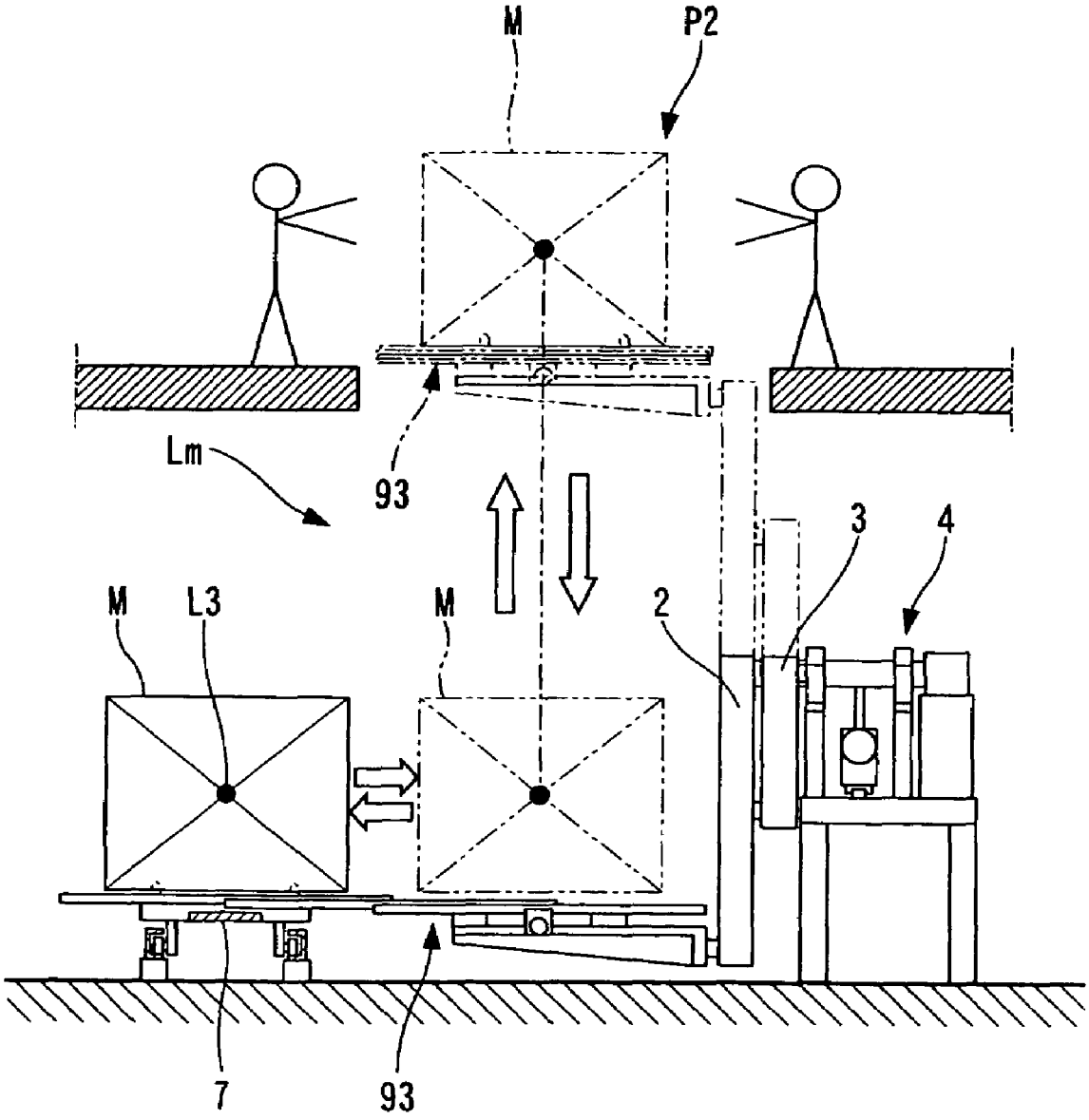
FIG. 18 is a general side view illustrating a modification example of the usage state of the elevating transport apparatus.

In the configuration shown in FIG. 18, the body M, which is transported with the transport cart 7 disposed movably on the lower transport line L4, is received by the fork apparatus 93 of the elevating transport apparatus 4 and elevated and transported to the upper processing and working position P2.

With the embodiment 6, the fork apparatus 93 that can deliver the body M located on the suspension transport apparatus 81 or transport cart 7 is provided at the free end portion of the crank arm 2. As a result, the body M can be smoothly elevated and transported between the transport lines L3, L4 and processing and working positions P1, P2. Further, the operation effect identical to that of Embodiment 5 can be demonstrated.

Embodiment 7

Figure 19:
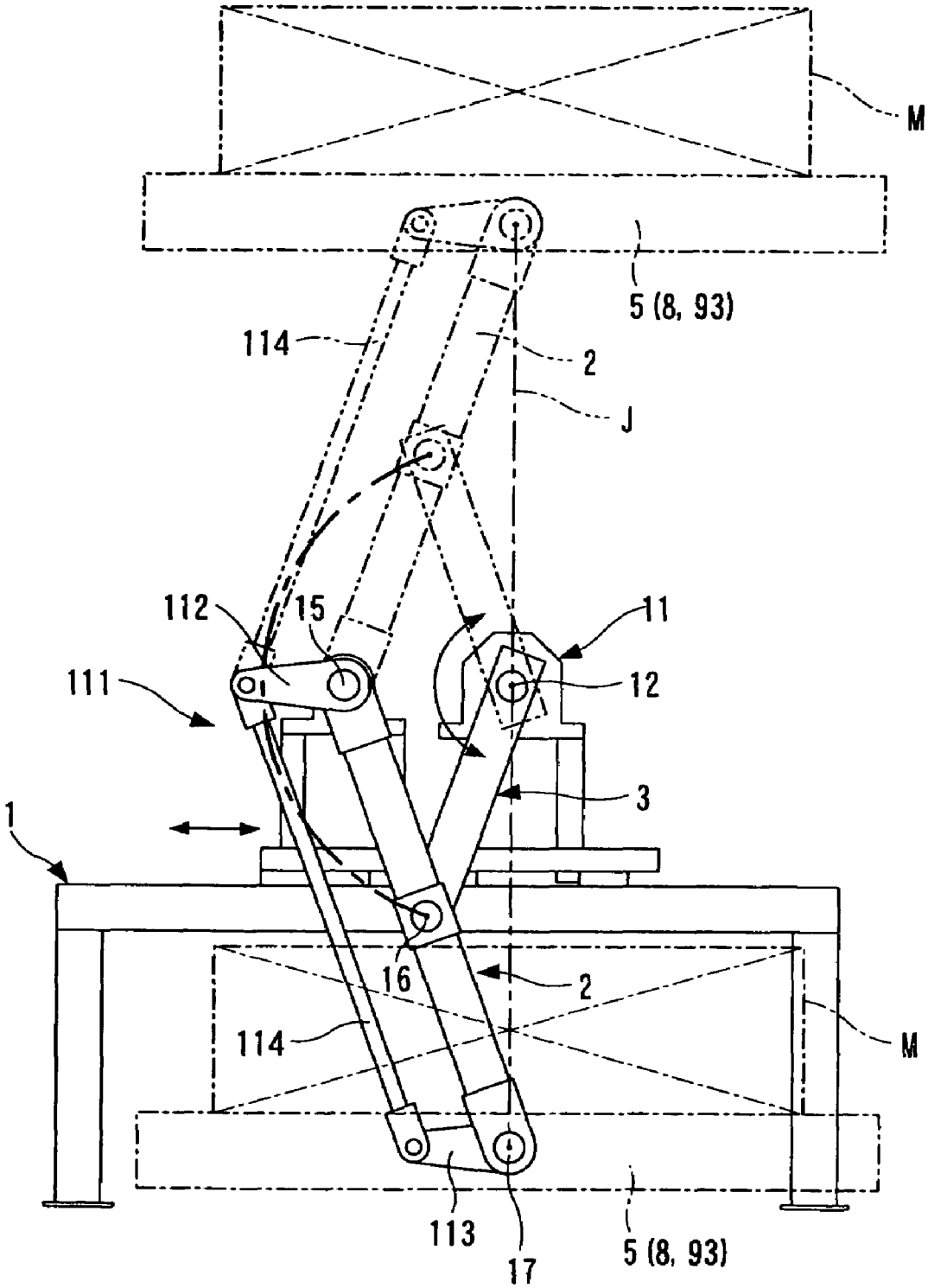
FIG. 19 is a schematic front view illustrating the posture adjustment apparatus illustrating Embodiment 7 of the elevating transport apparatus in accordance with the present invention.

Embodiment 7 will be described below with reference to FIG. 19. Components identical to those of the previously described embodiments are assigned with the same reference symbols and the explanation thereof is herein omitted.

Figure 20:
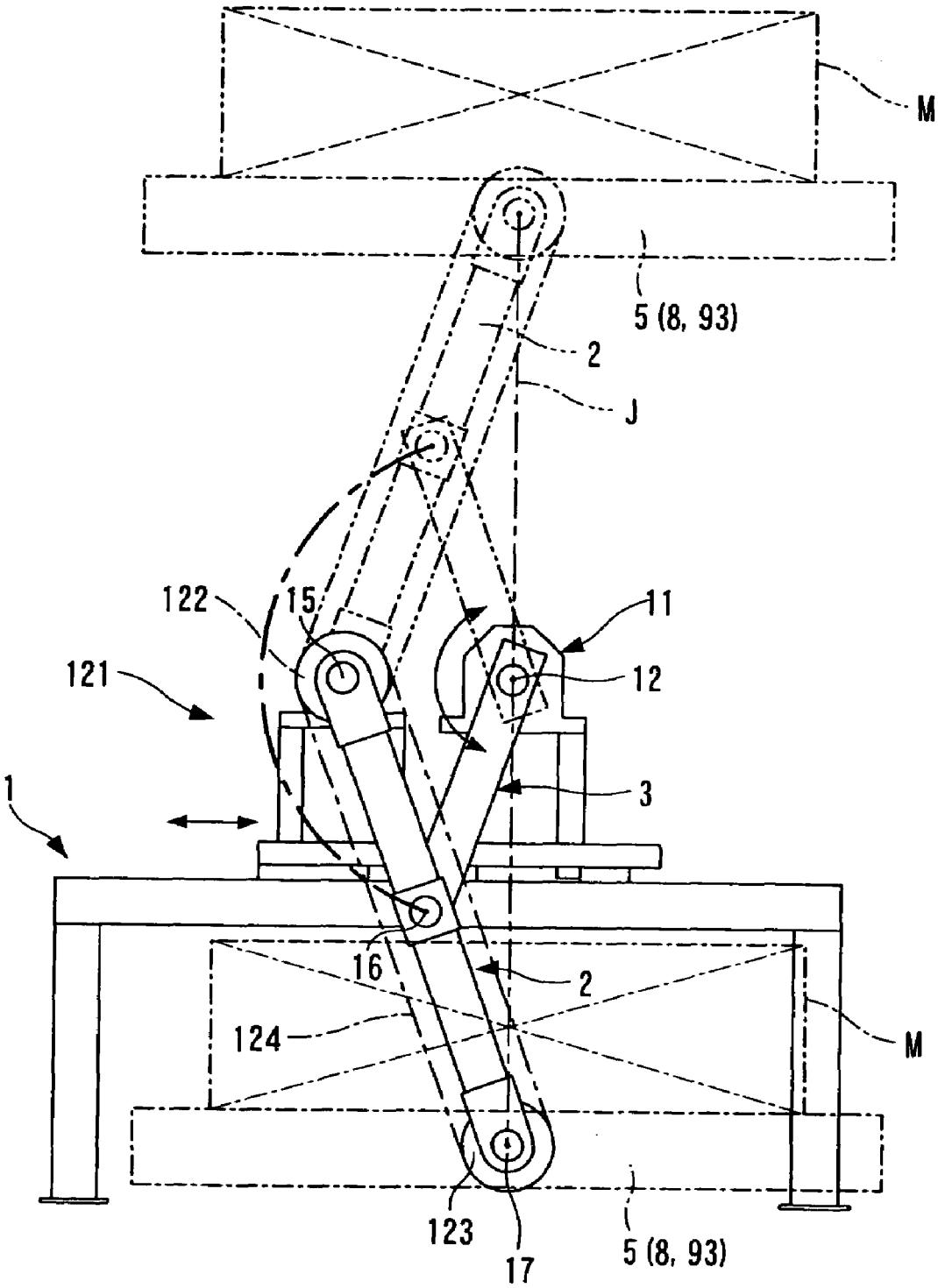
FIG. 20 is a schematic front view of the posture adjustment apparatus illustrating Embodiment 8 of the elevating transport apparatus in accordance with the present invention.

The posture adjustment apparatus 51 in Embodiments 1 to 6 has a configuration such that the movable transport rail apparatuses 5, 82 or fork apparatus 93 could be tilted and the posture of the body M to be transported, could be randomly adjusted with the posture adjustment drive apparatus 55. A posture adjustment apparatus 111 of Embodiment 7, as shown in FIG. 20, is provided with a parallel link mechanism providing for parallel movement of the movable transport rail apparatuses 5, 82 or fork apparatus 93.

Thus, the posture adjustment apparatus 111 comprises a fixed arm 112 that is rotatably supported on the front end section of the second support shaft 15 and fixed to the movable bearing member 14, a movable arm 113 fixed to the free end support shaft 17, and a link arm 114 rotatably linking the fixed arm 112 and movable arm 113.

With the above-described embodiment, the movable transport rail apparatuses 5, 82 or fork apparatus 93 can be always maintained in a horizontal state by the posture. adjustment apparatus 111 comprising the parallel link mechanism, posture control is unnecessary, and the operations can be implemented with a simple configuration.

In Embodiment 7, instead of using the fixed arm 112, a link arm 114 may be directly, or via a linking member, rotatably linked to the movable bearing member 14. Further, instead of using the movable arm 113, a link arm 114 may be directly, or via a linking member, rotatably linked to the movable rail apparatus 5 (or movable rail apparatus 82 and fork apparatus 93).

Embodiment 8

Embodiment 8 will be described below with reference to FIG. 20. Components identical to those of the previously described embodiments are assigned with the same reference symbols and the explanation thereof is herein omitted.

A posture adjustment apparatus 121 of Embodiment 8 comprises a chain link mechanism providing for parallel movement of the movable transport rail apparatuses 5, 82 or fork apparatus 93.

Thus, the posture adjustment apparatus 121 comprises a fixed sprocket 122 rotatably supported on the second support shaft 15 and linked and fixed to the movable bearing member 14, a movable sprocket 123 fixed to the free end support shaft 17, and a chain 124 stretched between the fixed sprocket 122 and movable sprocket 123.

With Embodiment 8, the operation effect identical to that of Embodiment 7 can be demonstrated.

Figure 21:
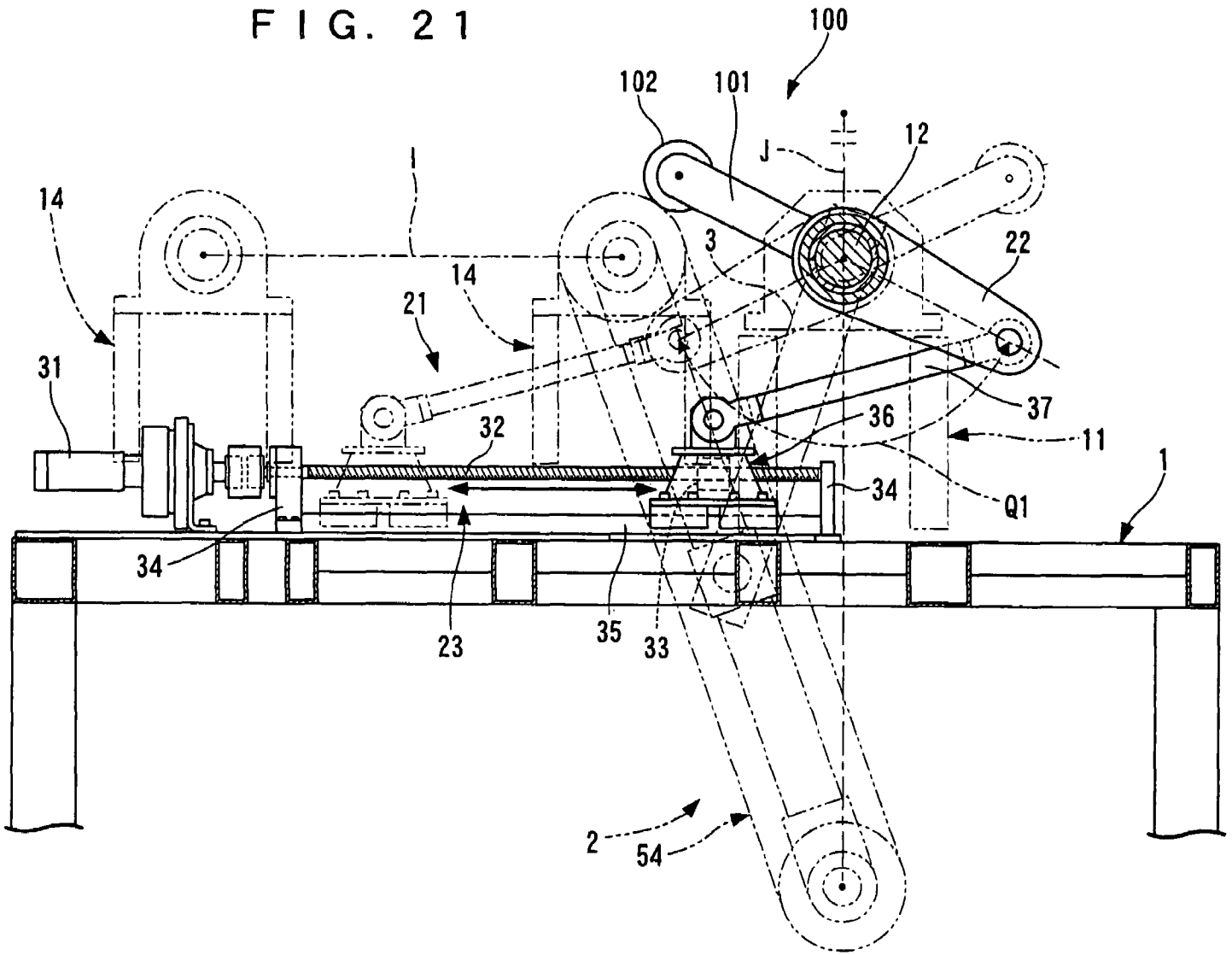
FIG. 21 is a front cross-sectional view illustrating a modification example of the elevating aid apparatus in each above-described elevating transport apparatus.

Further, the same effect can be demonstrated if an elevating aid apparatus 100 having a lever 101 fixed to the first support shaft 12 and a balance wheel 102 mounted on the free end section of the lever 101 and rotatably biasing the first support shaft 12 in the ascension direction is used as shown in FIG. 21, instead of the elevating aid apparatus 24 provided in Embodiments 1 to 8.

Further, the linear drive apparatus was described to have a jack structure of a threaded shaft type, but this configuration is not limiting and a linear drive can be carried out by employing a rack-and-pinion mechanism, a winding transmission mechanism having sprockets and a chain, a cylinder apparatus, and the like.

What is claimed is:

1. An elevating transport apparatus for elevating and transporting a body to be transported, with an elevating section connecting a transport path and a transport path positioned at different heights or an elevating section connecting the transport path and a processing and working position positioned at different heights, comprising:

a first support shaft in a horizontal direction;

a second support shaft disposed parallel to said first support shaft;

guide apparatuses for causing said second support shaft to freely move so as to approach or separate from said first support shaft;

a crank arm supported by said second support shaft;

a swing arm supported by said first support shaft and having a distal end portion linked via a linking shaft to an intermediate position of said crank arm;

a transport body support apparatus being rotatably supported via a free end support shaft on the free end section of said crank arm and supporting the body directly or via a transport machine, so that the posture thereof can be adjusted;

an arm drive apparatus for causing said crank arm to rotate in an up-down direction around said second support shaft; and a posture adjustment apparatus for rotating said transport body support apparatus around said free end support shaft and maintaining the horizontal posture thereof, wherein, said arm drive apparatus comprises a first passive lever fixed to said first support shaft, and a linear drive apparatus for push-pull driving the free end section of said first passive lever, an elevating aid apparatus enhancing the drive force of said linear drive apparatus and causing said first support shaft to be rotationally biased in the direction of raising said transport body support apparatus, and said transport body support apparatus is linked with said free end support shaft in the central portion of the crank arm side and supported by said crank arm in a cantilevered manner.

2. The elevating transport apparatus according to claim 1, wherein said transport body support apparatus comprises a rail apparatus having an elevating rail that can be connected to transport rails of said transport path.

3. The elevating transport apparatus according to claim 1, wherein said transport body support apparatus comprises a transfer apparatus for delivering said body to be transported, to the transport machine movably disposed on said transport paths.

4. The elevating transport apparatus according to claim 1, wherein said posture adjustment apparatus comprises a second passive lever fixed to said second support shaft, a linear drive apparatus for push-pull driving said second passive lever and causing said support shaft to move so as to approach or separate from said second support shaft, and a transmission device connecting and operably linking said second support shaft with said free end support shaft.

5. The elevating transport apparatus according to claim 1, wherein the optimum setting for the length of said crank arm from said second support shaft to said connection shaft, the length of said crank arm from the connection shaft to said free end support shaft, and the length of said swing arm from said first support shaft to the connection shaft is generally 1:1:1.

* * * * *